US006136452A

United States Patent [19]

Munir et al.

[11] Patent Number: 6,136,452

[45] **Date of Patent: *Oct. 24, 2000**

[54] CENTRIFUGAL SYNTHESIS AND PROCESSING OF FUNCTIONALLY GRADED MATERIALS

[75] Inventors: Zuhair A. Munir, Davis; Wei Nong Lai, Fremont; Subhash H. Risbud; Benjamin J. McCoy, both of Davis, all of Calif.

[73] Assignee: The Regents of the University of California, Oakland, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/032,216

[22] Filed: Feb. 27, 1998

[51] Int. Cl.[7] ..... B22D 19/14; B22D 25/00

[52] U.S. Cl. ..... 428/610; 164/97; 164/114

[58] Field of Search ..... 164/114, 115, 164/116, 117, 118, 97; 428/610

[56] References Cited

U.S. PATENT DOCUMENTS

| | | | |
|---|---|---|---|
| 4,528,010 | 7/1985 | Edahiro et al. . | |
| 5,316,068 | 5/1994 | Yagi et al. | 164/114 |

FOREIGN PATENT DOCUMENTS

| | | | |
|---|---|---|---|
| 2307600 | 11/1976 | France | 164/97 |
| 1-154861 | 6/1989 | Japan | 164/97 |
| 3-158435 | 7/1991 | Japan | 164/97 |
| 692683 | 10/1979 | U.S.S.R. | 164/114 |

OTHER PUBLICATIONS

Anselmi–Tamburini, U., et al., "The propagation of a solid–state combustion wave in Ni–Al foils", *Journal of Applied Physics,* 66:5039 (1989).

Bird, R.B., et al., *Transport Phenomena,* Wiley, New York (1960).

Blankenbecler, R., et al., "Gradient index glasses of macro dimensions and largeΔn", *Journal of Non–Crystal Solids,* 129:109 (1991).

Chigasaki, M., et al., "Partially Stabilized $ZrO_2$ and Cu FGM Prepared by Dynamic Ion Mixing Process", *Proceedings of the First International Symposium on FGM.* M. Yamanouchi, et al. (eds.), p. 269 (1990).

Dunmead, S.D., et al., "Simultaneous syntyesis and densification of TiC/Ni–Al composites", *Journal of Materials Science,* 26:2410 (1990).

Duval, D.J., et al., "Centrifugally–Assisted Size Classification and Immobilization of Silicon Crystallites in Gels", *Mat. Res. Soc. Symp. Proc.,* 298:109 (1993).

Fritscher, K., et al., "Density–Graded TBCs Processed by EB–PVD", *Proceedings of the First International Symposium on FGM,* M. Yamanouchi, et al. (eds.), p. 91 (1990).

Fu, Z.Y., et al., "Study on the Preparation of $TiB_2^{TiAl_3}Al$ Functionally Gradient Material by SHS Method", *Proceedings of the First International Symposium on FGM,* M. Yamanouchi, et al. (eds.), p. 175 (1990).

Fukushima, T., et al., "Gradient Coatings Formed by Plasma Twin Torches and those Properties", *Proceedings of the First International Symposium on FGM,* M. Yamanouchi, et al. (eds.), p. 145 (1990).

Geiger, G.H., et al., *Transport Phenomena in Metallurgy,* Addison–Wesley, p. 18 (1973).

Himmelbau, D.M., et al., "Process Analysis and Simulation–Deterministic Systems", Chapter 4, p. 192, Wiley, NY (1968).

Holt, J. B., et al., "Combustion synthesis of titanium carbide: theory and experiment", *Journal of Materials Science,* 21:251 (1986).

Houde–Walter, S.N., et al., "Delta–n control in Grin glass by additives in AgCl diffusion baths", *Applied Optics* 25:3373 (1986).

Hurst, J.B., "Characterization of Ceramics and Intermetallics Fabricated by Self–Propagating High–Temperature Synthesis", NASA Technical Memorandum 102004, May (1989).

Idem, *Handbood of Chemistry and Physics,* 49$^{th}$ Ed., Chemical Rubber Co., pp. B–172 and B–173 (1968).

Igari, T., et al., "Material Properties of Functionally Gradient Material for Fast Breeder Reactor", *Proceedings of the First International Symposium on FCM,* M. Yamanouchi, et al. (eds.), p. 209, (1990).

Ilschner, B., "Gradient Materials by Powder Metallurgy and by Galvanoforming", *Proceedings of the First International Symposium on FGM,* M. Yamanouchi, et al. (eds.), p. 101 (1990).

Kawai, C., et al., "Oxidation Resistant Coating with TiC–SiC Gradient Composition on Carbon Fiber Reinforced Composites by CVD", *Proceedings of the First International Symposium on FGM,* M. Yamanouchi, et al. (eds.), p. 77 (1990).

Kawai, T., et al., "A New Method for Forming a Piezo–Electric FGM Using a Dual Dispenser System", *Proceedings of the First International Symposium on FGM,* M. Yamanouchi, et al. (eds.), p. 191 (1990).

Kibrick, M., et al., "The Development of a Materials System for and Endosteal Tooth Implant", *Journal of Oral Implants,* 6:172 (1975).

(List continued on next page.)

*Primary Examiner*—Kuang Y. Lin

*Attorney, Agent, or Firm*—Townsend and Townsend and Crew LLP

[57] ABSTRACT

A method through which we can synthesize Functionally Graded Materials (FGM). Such materials are made so that their composition changes gradually from one point to another, such as in the example of gradient index (GRIN) optical components. A novel aspect of our method is the imposition of a centrifugal force during the combustion synthesis of composite materials for structural, optical, or electronic applications, with the result that the composition and the particle size of the metallic (or ceramic) component changes continuously and across the thickness of the product. We have prepared such FGM as $ZrO_2$+Ni, $ZrO_2$+Cu and $Al_2O_3$+Cu.

8 Claims, 17 Drawing Sheets

OTHER PUBLICATIONS

Kimura, O., et al., "Effects of Interfacial FGM Films on Thermal Stresses in Particle–Dispersed Ceramic Composites", *Proceedings of the First International Symposium on FGM,* M. Yamanouchi, et al. (eds.), p. 359 (1990).

Lai, W., "The Centrifugal Synthesis and Processing of Functionally Gradient Materials", MS Thesis, University of California, Davis, California, Abstract, (1999).

Matsuzaki, Y., et al., "Fundamental Studies of Fabricating Functionally Gradient Materials by SHS Process", *Proceedings of the First US–Japan Workshop on Combustion Synthesis,* Jan. 11–12, Tsukuba Science City, Y. Kaieda, et al. (eds.), National Research Institute for Metals, Tokyo, p. 89 (1990).

Merzhanov, A.G., et al., "The Self–propagating High Temperature Synthesis in the Field of Centrifugal Forces", *Proceedings of the First US–Japan Workshop on Combustion Synthesis,* Jan. 11–12, Tsukuba Science City, Y. Kaieda, et al. (eds.), National Research Institute for Metals, Tokyo, p. 1 (1990).

Miyamoto, Y., et al., "Processing Study for Functionally Gradient Material of TiC–Ni by the Gas–Pressure Combustion Sintering", *Proceedings of the First US–Japan Workshop on Combustion Synthesis,* Jan. 11–12, Tsukuba Science City, Y. Kaieda, et al. (eds.), National Research Institute for Metals, Tokyo, p. 173.

Munir, Z.A., "Synthesis of High Temperature Materials by Self–Propagating Combustion Methods", *American Ceramic Society Bulletin,* 67:342 (1988).

Munir, Z.A., et al., "Self–Propagating Exothermic Reactions: The Synthesis of High–Temperatue Materials by Combustion", *Materials Science Reports,* 3:277 (1989).

Odawara, O., "Metal–Ceramic Composite Pipes Produced by a Centrifugal–Thermit Process", *Combustion and Plasma Synthesis of High Temperature Materials.* Z.A. Munir, et al. (eds.), p. 179, VCH Pubhishers, NY (1990).

Pickering, M.A., et al., "Gradient infrared optical material prepated by a chemical vapor deposition process", *Applied Optics,* 25:3364 (1986).

Sasaki, M., et al., "Fabrication and Thermal Barrier Characteristics of CVD SiC/C Functionally Gradient Material", *Proceedings of the First International Symposium on FGM,* M. Yamanouchi, et al. (eds.) p. 83 (1990).

Sata, N., et al., "Research and Development on Functionally Gradient Materials by using a SHS process", *Proceedings of the First–US–Japan Workshop on Combustion Synthesis,* Jan. 11–12, Tsukuba Science City, Y. Kaieda, et al. (eds.), National Research Institute for Metals, Tokyo, p. 139 (1990).

Sata, N., et al., "Theoretical Predictions of the SHS/Non–SHS Boundary and the Establishment of the 'SHS Diagrams'", *Proceedings of the Fifth Symposium on High Temperature Materials Chemistry,* Oct. 14, Seattle, WA, Johnson, et al. (eds.), The Electrochemical Society (1990).

Sata, N., et al., "Fabrication of a Functionally Gradient Material by using a Self–Propagating Reaction Process", *Combustion and Plasma Synthesis of High Temperature Materials,* Z. A. Munir et al. (eds.), p. 195, VCH Publishers, NY (1990).

Serkov, B.B., et al., "Combustion of Condensed Systems in a Mass–Force Field", *Fiz. Gor. Vzryva,* 4:349 (1968).

Shih, Y.T., et al., "Hydrodynamics of Sedimentation of Multisized Particles", *Powder Technology,* 50:201 (1987).

Shimoda, N., et al., "Production of Functionally Gradient Materials by Applying Low Pressure Plasma Spray", *Proceedings of the First International Symposium on FGM,* M. Yamanouchi, et al. (eds.), p. 151 (1990).

Steffens, H.–D., et al., "Plasma Sprayed Functionally Gradient Materials—Processing and Applications", *Proceedings of the First International Symposium on FGM,* M. Yamanouchi, et al. (eds.), p. 139 (1990).

Tiller, F.M., "Revision of Kynch Sedimentation Theory", *A/ChE Journal,* 27:823 (1981).

Uemura, S., et al., "SiC/C Functionally Gradient Material Prepared by Chemical Vapor Deposition", *Proceedings of the First International Symposium on FGM,* M. Yamanouchi, et al. (eds.), p. 237 (1990).

Watanabe, R., et al., "Overall View of the P/M Fabrication of Functionally Gradient Materials", *Proceedings of the First International Symposium on FGM,* M. Yamanouchi, et al. (eds.), p. 107 (1990).

Yanagisawa, N., et al., "Fabrication of $TiB_2$–Cu Functionally Gradient Material by SHS Process", *Proceedings of the First International Symposium on FGM,* M. Yamanouchi, et al. (eds.), p. 179 (1990).

Yuki, M., et al., "Temperature Gradient Sintering of PSZ/Mo Functionally Gradient Material by Laser Beam Heating", *Proceedings of the First International Symposium on FGM.* M. Yamanouchi, et al. (eds.), p. 203 (1990).

10
0
-10
$\sigma_{11}/\sigma_{\perp}$
95
100
105
Radius (mm)
TiB2
Cu
2 Layers
3 Layers
FGM Phase Separation (%)
100
50
0
0
400
800
1200
1600
2000
g/g0
MoO3 + Al + C
WO3 + CoO + Al + C
WO3 + Al + C Thermal Expansion Coefficient
α (x 10-7/°C)
30
20
10
5
0
Na2O
P2O5
GeO2
B2O3
Al2O3
TiO2
0
5
10
15
20
Dopant Concentration (mol%)

CENTRIFUGAL SYNTHESIS AND PROCESSING OF FUNCTIONALLY GRADED MATERIALS

This invention was made with Government support under Grant No. CTS-9011242, awarded by the National Science Foundation. The Government has certain rights in this invention.

BACKGROUND OF THE INVENTION

The imposition of a compositional gradient across a piece of material results, expectedly, in a concomitant gradient in the properties of this material. Such functionally graded materials, or FGM, have recently been the focus of intense investigations, primarily in Japan. Although the initial emphasis was on the synthesis and processing of thermal barrier material for space applications {T. Hirano, Second Symposium for Functionally Gradient Materials, Jul. 1, 1988, Tokyo, The FGM Research Society, *Kino Zairyo* 8:15 (1988)}, e.g., the National Space Plane and shuttle engines, subsequent investigations have focused on other areas in which the application of FGM provides novel and effective solutions to existing materials problems. These latter areas include the use of FGM in nuclear fusion and fast breeder reactors (as first wall composite materials) {M. Seki, ibid, *Kino Zairyo* 8:7 (1988); T. Igari, et al., *Proceedings of the First International Symposium on FCM;* M. Yamanouchi, et al. (eds.), p.11 (1990)}, in electronic and magnetic applications (electro-ceramics, sensors), in optical applications (high performance laser rods, optical disks), in chemical applications (membranes, catalysts), in biomedical materials (tooth implants, artificial bones), and in joining applications (ceramic engines, heat and corrosion resistance coatings) {M. Niino, *Kino Zairyo* 7:31 (1987); T. Kawai, et al., *Proceedings of the First International Symposium on FGM.* M. Yamanouchi, et al. (eds.) p. 191 (1990); M. Yuki, et al., ibid, p. 203; M. Chigasaki, et al., ibid, p. 269}. The use of FGM in heat applications is exemplified by the proposed utilization of a $TiB_2$/Cu FGM in a reusable rocket engine {T. Hirano, supra}. The ceramic side ($TiB_2$) of this FGM is designed to withstand 1500 K while the metallic (Cu) side is designed for operation at 300 K The advantage of a functionally gradient $TiB_2$/Cu material relative to two layer ($TiB_2$+Cu) and three layer ($TiB_2$+50% $TiB_2$+Cu) alternatives is demonstrated by the results shown in FIG. 1 {T. Hirano, supra}. In cases of a multi-layer system, tensile stresses are generated at the interfaces while, in contrast, the FGM material experiences basically a compressive stress throughout. The existence of tensile stresses at the interfaces in the multi-layer systems is the primary cause of their failure.

To provide a continuous or semi-continuous compositional gradient in functionally graded materials, several synthesis methods have been utilized. These include chemical and physical vapor deposition (CVD and PVD) {S. Ikeno, Second Symposium for Functionally Gradient Materials, Jul. 1, 1988, Tokyo, The FGM Research Society, *Kino Zairyo* 8:19 (1988); T. Kirai, *FGM News,* Tokyo, May 1988, p. 10; M. Sasaki, et al., *Proceedings of the First International Symposium on FGM,* M. Yamanouchi, et al., (eds.) p. 83 (1990); K. Fritscher, et al., ibid, p. 91; S. Uema, et al., ibid, p. 237}, thermal and plasma spray {T. Fukushima, Second Symposium for Functionally Gradient Materials, Jul. 1, 1988, Tokyo, The FGM Research Society, *Kino Zairyo* 8:31 (1988); H. Steffens, et al., *Proceedings of the First International Symposium on FGM,* M. Yamanouchi, et al. (eds.), p. 139 (1990); T. Fukushima, et a., ibid, p. 145; N. Shimoda, et al., ibid, p. 151}, powder metallurgy techniques {N. Tsutsumi, ibid, Kino Zairyo 8:39 (1988); R. Watanabe, FGM News, Tokyo, May 1988, p. 14; B. Ilschner, *Proceedings of the First International Symposium on FGM,* M. Yamanouchi, et al. (eds.), p. 101 (1990); R. Watanabe, et al., ibid, p. 107}, and self-propagating exothermic reactions {N. Sata, Second Symposium for Functionally Gradient Materials, Jul. 1, 1988, Tokyo, The FGM Research Society, *Kino Zairyo* 8:35 (1988); Y. Matsuzaki, et al., *Proceedings of the First US-Japan Workshop on Combustion Synthesis,* Jan. 11–12, 1990, Tsukuba Science City, Y. Kaieda, et al. (eds.), National Research Institute for Metals, Tokyo, p. 89; N. Sata, et al., ibid, p. 139; Y. Miyamoto, et al., ibid, p. 173; N. Sata, et al., *Combustion and Plasma Synthesis of High Temperature Materials,* Z. A. Munir et al., (eds.), p. 195. VCH Publishers, NY (1990); Z. Y. Fu, et al., *Proceedings of the First International Symposium on FGM,* M. Yamanouchi, et al. (eds.), p. 175 (1990); N. Yanagisawa, et al., ibid, p. 179}. Compared to others, the method of self-propagating exothermic reactions has the general advantages of simplicity, low cost, and the relative ease of preparing larger items. In this method, layers of reactants with gradually changing compositions are pressed together and then ignited at one end of the multi-layer ensembles to initiate a self-sustaining reaction front. The product then comprises regions in which the composition is constant but is incrementally different from that in the two adjacent layers. Thus, the composition changes in a step fashion from one end of the sample to the other.

Despite its attractive features, this method suffers from two general disadvantages. The use of reactant layers with a successively changing composition can lead to the existence of discontinuities in composition at the interfaces. The second disadvantage relates to the nature of the self-propagating reaction: a compositional limit exists at which the reaction enthalpy is not sufficiently high to sustain the combustion wave {Z. A. Munir, *American Ceramic Society Bulletin,* 67:342 (1988); Z. A. Munir, et al., *Materials Science Reports,* 3:277 (1989); N. Sata, et al., *Proceedings of the Fifth Symposium on High Temperature Materials Chemistry,* Oct. 14, 1990, Seattle, Wash., W. Johnson, et al. (eds.), The Electrochemical Society}. This implies in the case of the $TiB_2$-Cu system, for example, that a gradient from pure $TiB_2$ to pure Cu cannot be established by combustion synthesis. At higher copper contents, the reaction Ti+2B+Cu is not self-sustaining. To mitigate the first problem, thinner layers with small compositional differences can be used to prepare the FGM, but this solution adds complexity to the process and diminishes one of its attractive features. The second problem, on the other hand, does not have a simple solution.

The prospect of inducing deliberately designed compositional gradients in optical and electronic materials is extremely attractive in the synthesis of special materials. For instance, gradient index (GRIN) optical elements are now a well accepted part of modern photonic and communication devices. These materials have a well controlled and continuous change in the refractive index and find applications in fiber optic couplers, photocopiers, miniaturized optical systems, and medical endoscopes. The effectiveness of such GRIN elements is strongly determined by the extent of the radial or axial refractive index change ($\Delta n$) that can be obtained in bulk disks or cylindrical preforms of the optical component. GRIN lenses with large refractive index variations ($\Delta n>0.1$) and low dispersion are sought as optical blanks for processing of components with a variety of profiles and symmetry.

In conventional ion exchange processes {S. N. Houde-Walter, et al., *Applied Optics* 25:3373 (1986)}, a glass rod of homogeneous composition is treated in a salt bath ($NaNO_3$+NaCl) to allow $Na^+$ exchange at the surface. Thus, a surface layer will have a slightly different composition relative to the bulk and this in turn alters the refractive index. The range of Δn values obtained in this process is of the order of ≈0.01 to 0.05. For example, $TiO_2$-$SiO_2$ rods, 2 to 3.5 mm in diameter, have been used to obtain lenses with Δn=0.015 to 0.025. In addition to CVD and sol-gel processing {M. Pickering, et al., ibid, 25:3364 (1986); T. Edahiro, et al., U.S. Pat. No. 4,528,010, Jul. 9, 1985}, other methods for the preparation of materials with a significant Δn include the co-melting of layers of powdered glasses of different composition to synthesize bulk optical quality materials with Δn=0.3 to 0.5 {R. Blankenbecler, et al., *Journal of Non-Crystal Solids,* 129:109 (1991)}. The composition profiles are not very smooth, however, and the process is completely dependent on adequate precision during the mechanical layering of the powders and melt interdiffusion under normal gravity conditions.

Centrifugally-assisted FGM processing is a new synthesis technique for the preparation of these GRIN optical elements, especially since it permits layering of the constituents of the powdered batch under a strong gravity field (50 $g_o$). The resulting GRIN material is continuously graded in composition and refractive index and the possibility of creating large Δn in bulk samples, through the innovative use of centrifugally assisted FGM processing, is a major advance over current synthesis methods for GRIN optical materials.

Another important area in which FGM processing is desirable is quantum dot materials. In quantum dot materials, the band gap of a bulk semiconductor is shifted significantly by reducing its particle size to a value smaller than the exciton (electron-hole pair) Bohr radius. The most exciting possibility here is the potential for tailoring quantum devices by size-selection of the semiconductor in nanometer dimensions. Bulk quantum dot materials are composites of semiconductor particles (e.g., CdSe, GaAs) suspended in a ceramic or glass medium. The quality of quantum confinement, i.e., the optical density, is related to the concentration of semiconductor particles and it is here that FGM processing can result in some unique materials with a gradient in semiconductor quantum dot concentration. FGM processing also has the potential for creating quantum-confined structures with predictable quantum dot concentrations in various regions of the same bulk sample. The study of the optical absorption spectra of such samples can be expected to give useful insights into the band structure transitions in these materials. It will be particularly interesting to investigate the non-linear optical response in a bulk solid processed by FGM as the non-linearity can be investigated point to point by moving the laser beam across areas of variable optical density.

A central feature of the method of the present invention is the use of a centrifugal force ($F_c$) to prepare graded materials with controlled, continuous compositional gradients. The use of a centrifugal force in self-propagating synthesis has been shown to modify the process itself as well as the macroscopic characteristics of the product. However, the primary focus of the use of a centrifugal force has been, thus far, the separation of the product phases to obtain cast materials {A. G. Merzhanov, et al., *Nauchnye Osnovy Materialovedniia,* Moscow, p. 193 (1981 )}. For the centrifugal force to have an effect, a product or an intermediate phase should be in the liquid state and the phases to be separated should differ in their specific gravity. An example of such a system is the thermite reaction:

$$Fe_2O_3+2Al=Al_2O_3+2Fe \quad (1)$$

The adiabatic temperature (3400 K) for this reaction exceeds the melting points of both product phases. However, under actual experimental conditions (where adiabatic conditions are not maintained) or with the addition of appropriate amounts of a diluent (in this case, $Al_2O_3$), the combustion conditions give rise to the formation of solid $Al_2O_3$ and liquid Fe. Under such conditions, the application of a centrifugal force, $F_c$, leads to the separation of the lighter phase $Al_2O_3$ ($\rho$=3.5 g. $cm^{-3}$) to the top of the heavier phase, Fe ($\rho$=7.86 g. $cm^{-3}$). This process has been commercially utilized in Japan to place a corrosion-resistant coating ($Al_2O_3$) on the inside of steel pipes {O. Odawara, Japanese Patent # JP55-341416 (1980); O. Odawara, *Combustion and Plasma Synthesis of High Temperature Materials,* Z. A. Munir, et al. (eds.), p. 179, VCH Publishers, NY (1990)}.

Several investigations on the effect of a centrifugal force on the process of self-propagating synthesis have been made {A. G. Merzhanov, et al., *Proceedings of the First US-Japan Workshop on Combustion Synthesis,* Jan. 11–12, 1990, Tsukuba Science City, Y. Kaieda, et al. (eds.), National Research Institute for Metals, Tokyo, p. 1}. However, the emphasis of these experimental studies has been the determination of the effect of $F_c$ on the parameters of the combustion process. No systematic study involving theoretical fundamentals of phase separation appears to have been made and no attempt has been made to use a centrifugal force to prepare functionally graded materials with controlled compositional distributions.

An example of the effect of $F_c$ on the velocity of the combustion wave of the reaction described by Eq(1) is shown in FIG. 2 {B. B. Serkov, et al., *Fiz. Gor. Vzryva,* 4:600 (1968)}. For this reaction, the wave velocity increases almost linearly with increasing $F_c$ (in this figure, $F_c$ is represented by the ratio of the acceleration, g, to that of gravity, $g_o$). This effect, however, is not universal and is a function of two factors with opposite effects: (a) an increase in rate due to gravity-enhanced permeation of the liquid phase ahead of the wave, and (b) an increase in heat loss due to increased convection in the liquid phases in the combustion zone. The net influence of $F_c$ depends on the relative contribution of these two factors. In highly exothermic reactions the velocity, u, increases dramatically with increasing $F_c$ (curve a), and in moderately exothermic reactions the influence of $F_c$ on u shows a maximum (curves b and c), as seen in FIG. 3 {S. A. Karataskov, et al., ibid, 6:41 (1985)}. The maximum is a consequence of the change in dominance of the two factors discussed above. At lower values of $F_c$ the process is dominated by liquid permeation and at higher values of $F_c$ it is dominated by heat loss due to convection. The importance of a gravitational force on combustion synthesis reactions is underscored by observations that for weakly exothermic reactions, a self-propagating wave can only be established under the influence of $F_c$ (curve d in FIG. 3) and for moderately exothermic reactions (those exhibiting a maximum in u vs $F_c$) increasing the gravitational force can lead to the extinction of the combustion wave (curve b).

Phase separation as a result of the application of $F_c$ depends on the strength of the force $F_c$, the viscosity of the liquid phase, the size of the solid particles being separated, the difference between the densities of the liquid and solid phases, and the time during which the centrifugal force is in effect. Since the influence of this force is only seen when a liquid phase is present, the parameter of time, therefore, is dictated by the nature of the combustion process. FIG. 4 shows a schematic representation of the temperature profiles of two combustion reactions in which the effective times are indicated as $t_1$ and $t_2$ for the highly exothermic reaction 1 and the less exothermic reaction 2, respectively. In general, phases in systems with higher combustion temperatures can be separated easier than those with lower combustion temperatures. Since the combustion temperature can be controlled by dilution {J. B. Holt, et al., *Journal of Materials Science,* 21:251 (1986)}, the effective time of the application of $F_c$ can be experimentally varied.

Experimental observations on the effect of $F_c$ on phase separation are shown in FIG. 5 {Merzhanov, et al., supra). It is significant to note that the transition between "no separation" and total separation depends on the system investigated and can take place over a relatively narrow range of $F_c$ values (for the reaction $WO_3$+CoO+Al+C) or over a wide range of $F_c$ (for the reaction $WO_3$+Al+C).

In a recent investigation {J. B. Hurst, NASA Technical Memorandum 102004, May 1989}, the effect of gravity on phase separation in products of combustion synthesis of nickel aluminides was examined. Cylindrical samples were ignited, in one case at the bottom and the other case at the top. Although no phase separation was detected (under 1 $g_o$ gravity), an interesting observation was made with regard to pore formation. While the total porosity of both types of samples was the same, those that were ignited from the bottom had markedly larger pores when compared to those samples ignited at the top. Qualitatively, these observations suggest that pore segregation occurs in the combustion (liquid) zone. In the case where the wave is propagating in an upward direction, pores that segregate to the top of the combustion zone are swept in the same direction as the wave and coalescence with other pores is likely. With a downward moving wave, pores that segregate to the top of the combustion zone are left behind with little likelihood of growth by coalescence. The effect of a gravitational force of higher than 1 $g_o$ on the size and distribution of pores in this or other systems was not investigated.

SUMMARY OF THE INVENTION

Functionally Graded Materials have been prepared by a variety of methods. None of these have used a gravitational force to effect the desired compositional gradient. Another novel aspect of our approach is to couple a gravitational force to the process of combustion synthesis. As long as the phases in the product differ in their specific gravity, an effective gradual distribution can be achieved under the gravitational force. Although FGM have been prepared by combustion synthesis, the approach taken thus far does not result in a smooth compositional gradient.

The functionally graded materials, i.e., composites with a spatial gradient in compositions, of particular interest are metal-ceramic composites having a gradient in the density of ceramic particles embedded in the metal matrix. Such materials are heat resistant in the region where the ceramic concentration is high, and have high strength where the metal concentration is high. We are disclosing two novel techniques to produce FGMs by centrifuging particles into molten metal: (1) combustion synthesis with centrifugation, and (2) thermal melting of metals with centrifugation of particles into the melt. Preliminary results indicate the potential of these techniques to achieve smoothly-varying gradients of composition. Calculations based on mathematical models of phase separation (particle sedimentation) in molten metals are consistent with the experimental observations.

To provide the details of one version of our invention, we use the example of preparing a functionally graded material/ceramic composite such as $ZrO_2$+Cu. For this we start by mixing copper oxide, CuO, and zirconium metal, Zr. The powders are then pressed together to form a cylindrically-shaped sample. The sample is then placed in a centrifuge capable of providing an acceleration of 100 g or more. Once the gravitational force is applied, the sample is ignited at one end and a combustion wave is established. In the system we have chosen, and in many other systems, at least one component of the reaction is in the liquid state. In this case the metal copper will be liquid. Because of the imposed gravitational force and the fact that the specific gravities of the two product phases (copper and zirconium oxide) are different, a phase separation will take place. The nature of the compositional gradient, i.e., its steepness, depends on the materials' properties (e.g., their specific gravities), on the combustion process (e.g., the combustion temperature), and on the magnitude and duration of the imposed gravitational field. In contrast to the method of formation of FGM by combustion synthesis, our method can produce graded materials in which the phases can change from pure ceramic to pure metallic, or in an all oxide system, gradients affecting important optical properties (e.g., refractive index) can be deliberately designed.

DETAILED DESCRIPTION OF THE INVENTION

Figure 1:
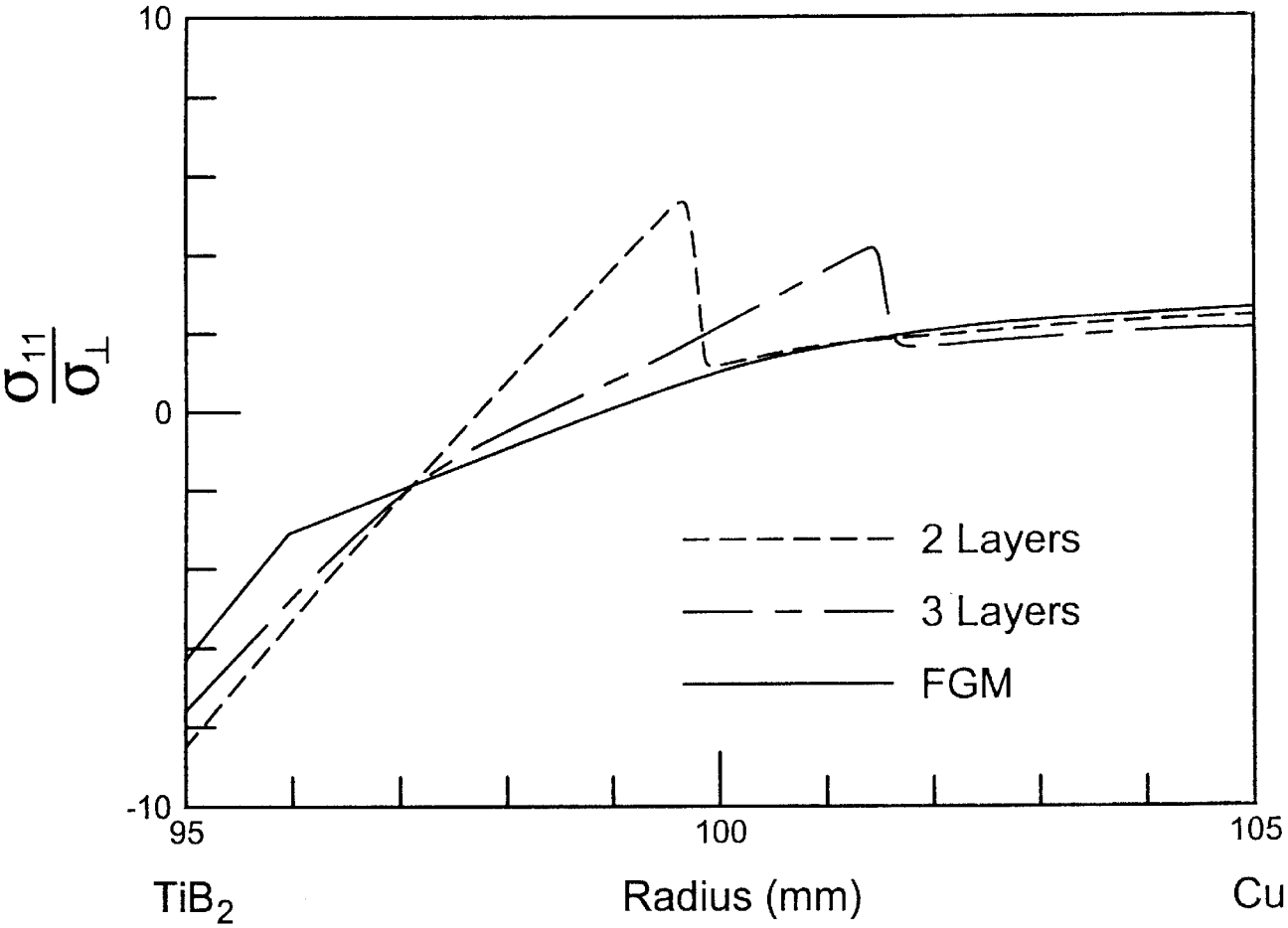
FIG. 1. Comparison of ratios of tensile to compressive stresses at the interface for multi-layer and FGM coatings in the $TiB_2$/Cu system {T. Hirano, *Second Symposium for Functionally Gradient Materials,* Jul. 1, 1988, Tokyo, The FGM Research Society, *Kino Zairyo* 8:15 (1988)}.
Figure 2:
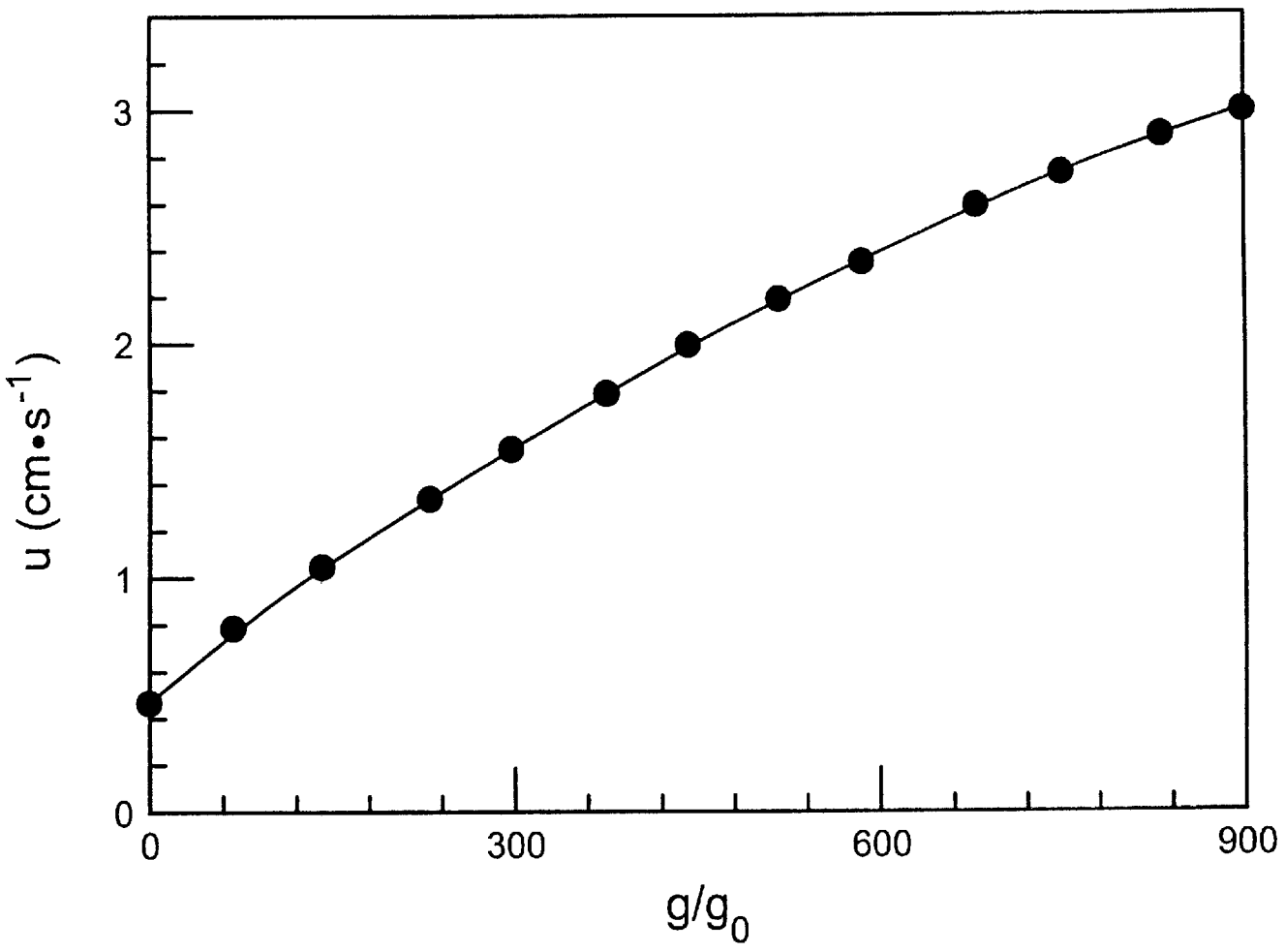
FIG. 2. The effect of a centrifugal force on the wave velocity of the thermite reaction $Fe_2O_3$+2Al=$Al_2O_3$+2Fe {B. B. Serkov, et et al., *Fiz. Gor. Vzryva,* 4:600 (1968)}.
Figure 3:
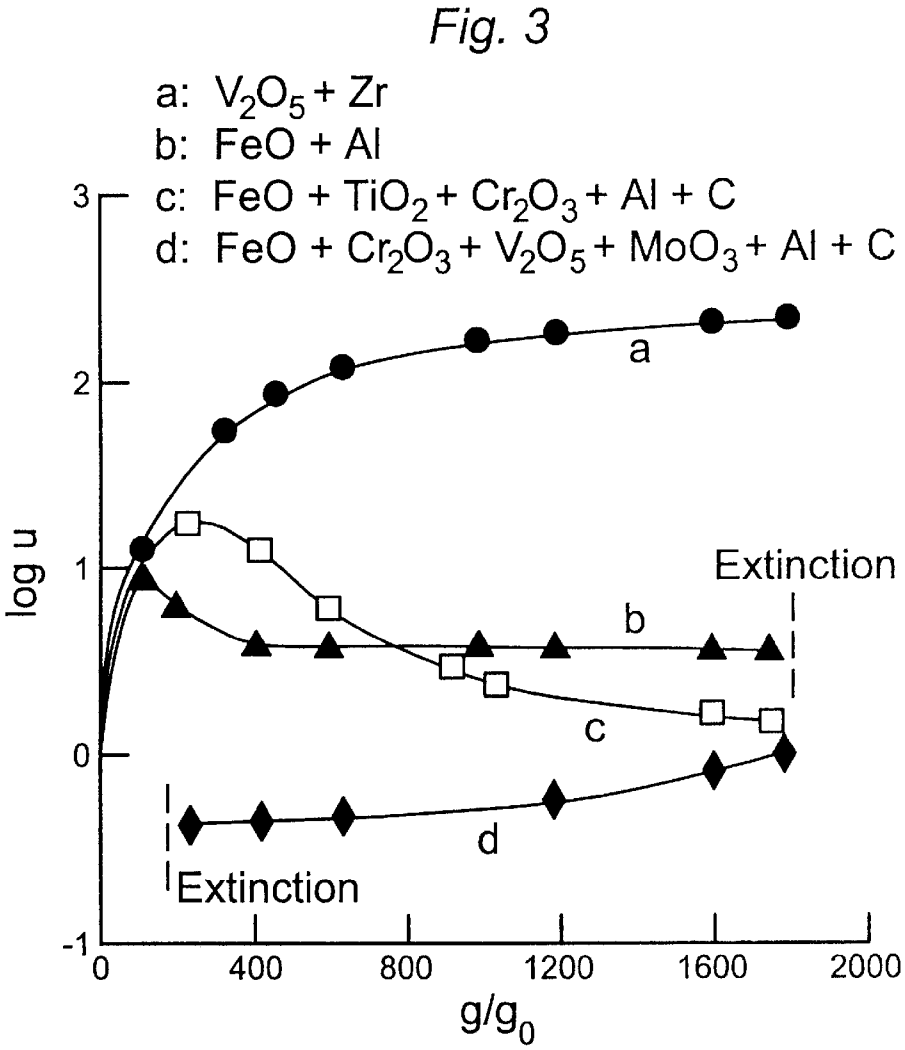
FIG. 3. The various effects of a gravitational force on the velocity of the combustion wave for selected reactions {S. A. Karataskov, et al., ibid, 6:41 (1985)}.
Figure 4:
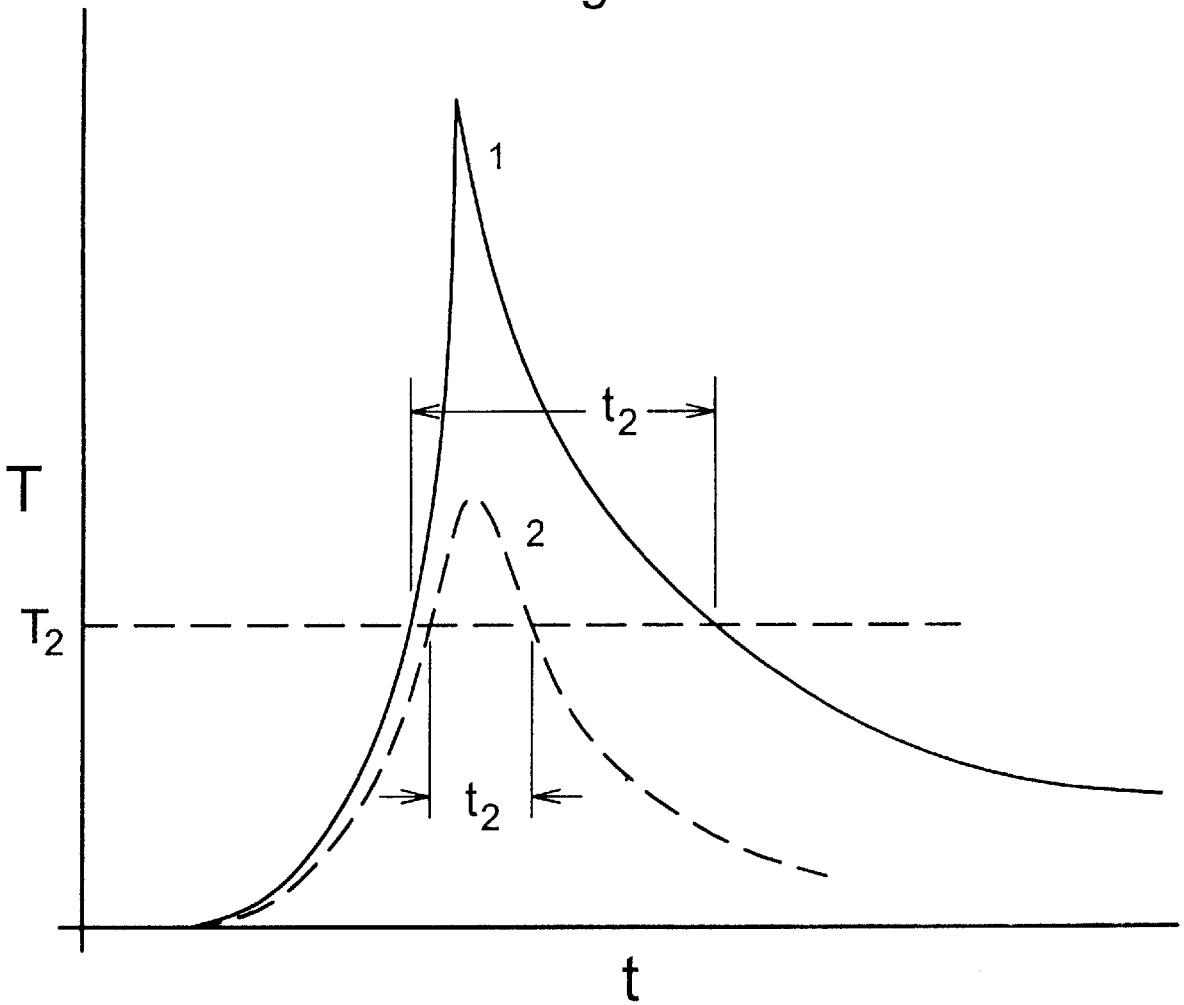
FIG. 4. Schematic representation of the temperature profiles of two combustion synthesis reactions.
Figure 5:
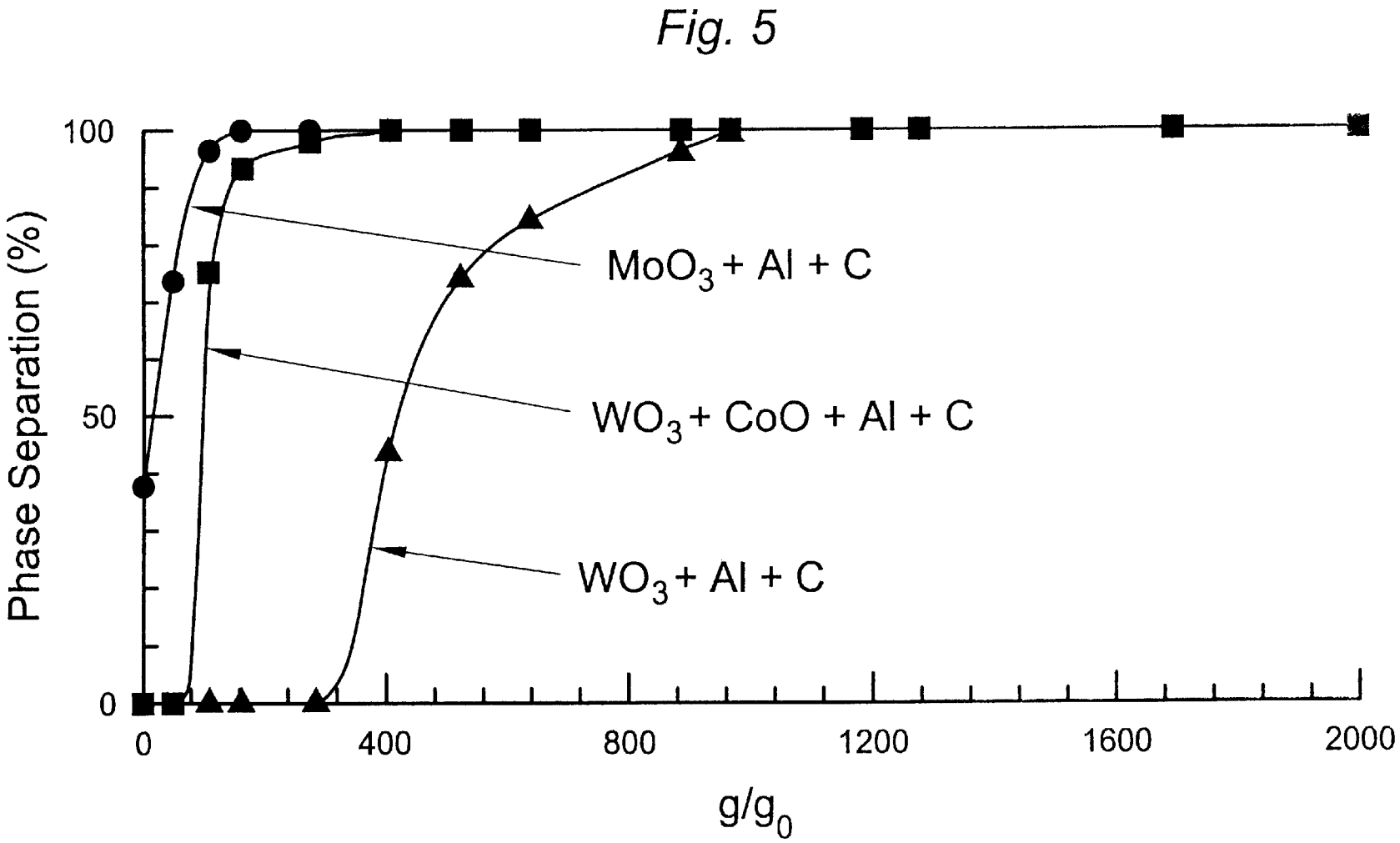
FIG. 5. The effect of a gravitational force on the phase separation of products of selected reactions {A. G. Merzhanov, et al., *Proceedings of the First US-Japan Workshop on Combustion Synthesis,* Jan. 11–12, 1990, Tsukuba Science City, Y. Kaieda, et al. (eds.), National Research Institute for Metals, Tokyo, p.1)

An understanding of the separation of particles of different sizes that are being formed and growing in a melt is needed for process design and optimization of centrifugal FGM processing. A mathematical treatment of particle phase separation (sedimentation) and the resulting compositional gradient is based on a distribution function for the particle size, f (r, z, t), which depends upon time, t, and the position, z, in the vessel, i.e., f (r, z, t) dr is the number of particles (per unit vol) in the size range (r, r, +dr) and located at (z, t). It is assumed that the particles are spheres of radius, r, and that z is measured in the direction of particle motion. The governing partial differential equation for such a particle-size distribution function is the same equation used in population-balance models {D. M. Himmelbau, et al., *Process Analysis and Simulation-Deterministic Systems,* Chapter 4, Wiley, NY (1 968)}, i.e., $$\frac{df}{dt} + \frac{d(vf)}{dz} + \frac{d(\Omega f)}{dr} = G \tag{2}$$

where Ω(r, z, t) is the rate of growth of particles, and G(r, z, t) is the net generation rate of the spherical particles. The terminal velocity of the spheres in the melt is written as $$v = \Phi r^2 \text{ where } \Phi = \left(\frac{2}{9}\right)(\rho_s - \rho_L)\frac{g}{\mu} \tag{3}$$

in terms of the densities of the solid and liquid phases, $\rho_S$ and $\rho_L$, the melt viscosity, $\mu$, and the centrifugal acceleration, $g=ag_o$, expressed as a multiple of the gravitational acceleration, $g_o$. The expression for v is based on the assumption that the particles are sufficiently far apart that particle—particle interaction can be neglected. Particle interaction (hindered settling) can be included with an appropriate functional form of the velocity, v, or with Kynch sedimentation theory {F. M. Tiller, *AIChE Journal,* 27:823 (1981)}. Other complications, such as convective effects for mixtures of buoyant and heavy particles and vessel wall influence, can also be treated mathematically {Y. T. Shih, et al., *Powder Technology.* 50:201 (1987)}.

The particle-size distribution function is related to observable quantities. The volume fraction of particles is defined as $$F(z, t) = \int_o^\infty \left(\frac{4}{3}\right)\pi r^3 f(r, z, t)\,dr \tag{4}$$

and the volume flux of particles is given by $$J(z, t) = \int_o^\infty v\left(\frac{4}{3}\right)\pi r^3 f(r, z, t)\,dr \tag{5}$$

in terms of the particle velocity $v=\phi r^2$. The particles are deposited when they reach the end of the vessel at z=L. The volume of deposit (per unit area) at time, t, can be written as $$D(t) = \int_o^t J(z = L - h, \tau)\,d\tau \tag{6}$$

where the deposit depth, h, grows with time, and is defined in terms of the deposit volume fraction, $F_s$, $$h(t) = \frac{D(t)}{F_s} \tag{7}$$

For dense deposits, h<<L, and J (z=L, t) is a suitable approximation in Eq(6).

The population balance equation in general requires a numerical solution, but some special cases of interest in centrifugal FGM processing can be solved analytically in closed form. In principle the predicted volume fraction gradient can be used to estimate other property gradients in the FGM, e.g., density, heat capacity, thermal conductivity, thermal expansion coefficient, refractive index, and elasticity constants.

Results for the gradient in volume fraction of particles in the melt are illustrated by calculations based on the model system of $Al_2O_3$ particles in molten Al. The properties of the system are provided in Table I.

TABLE I

Properties of the Centrifugal Sedimentation of $Al_2O_3$ Particles in Molten Al.

| | | | |
|---|---|---|---|
| density† of $Al_2O_3$ particles | $\rho_s$ | = | 3.97 g/cm$^3$ |
| density†† of molten Al | $\rho_L$ | = | 2.70 g/cm$^3$ |
| viscosity††† of molten Al | $\mu$ | = | 2.0 cp |
| centrifugal acceleration | g | = | 5 $g_o$, $g_o$ = 980 cm/s$^2$ |
| $v = \phi r^2$, with | $\phi$ | = | 70550/s cm |
| largest particle radius | $r_o$ | = | 0.0001 cm |
| length of vessel | L | = | 1.00 cm |
| final depth of deposit | $h_\infty$ | = | 0.10 cm |

†R. C. Weist, Handbook of Chemistry and Physics, 49th Ed., Chemical Rubber Co., p. B173 (1968).
††Idem, ibid, p. B172.
†††G. H. Geiger, D. R. Poirier, Transport Phenomena in Metallurgy, Addison-Wesley, p. 18 (1973).

Figure 6:
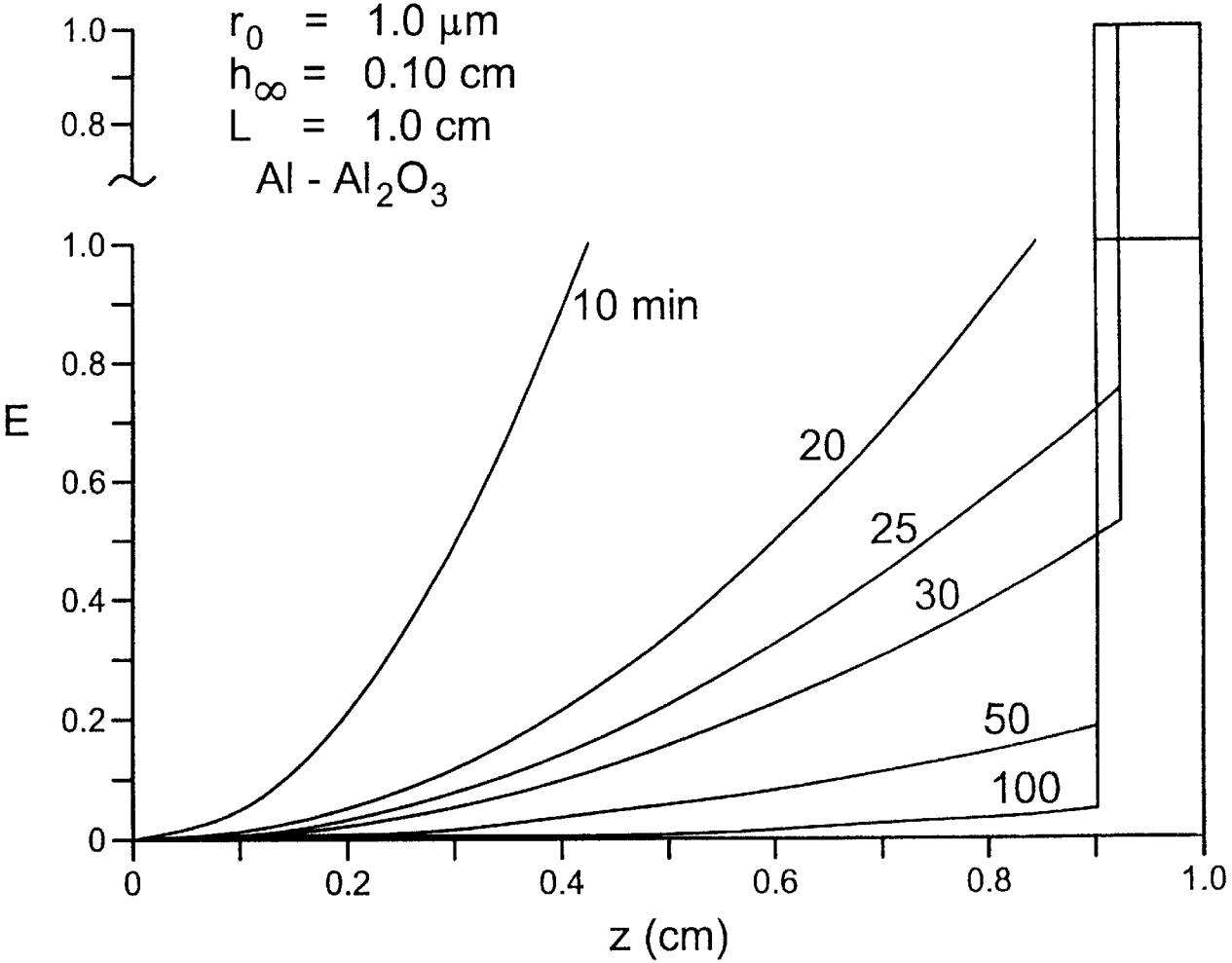
FIG. 6. Calculated gradients in volume fractions for the Al-$Al_2O_3$ system subjected to 5 $g_o$ for various times.

FIG. 6 shows the reduced volume fraction versus length coordinate, z, for an initial uniform and constant distribution of $Al_2O_3$ particles of size less than $r_0$=1 $\mu$m. For these rather small particles, the centrifugal phase separation at 5 $g_0$ requires on the order of an hour for most particles to deposit. For shorter times, a well characterized gradient in the concentration of these particles can be established. The deposit layer grows with time as indicated at the right-hand side of FIG. 6. Since the larger particles are deposited before smaller particles, one expects a gradient in particle size within the deposit. A gradient in particle size is also expected in the distribution prior to the complete phase separation.

Thus, for a multisized particle sample, the FGM comprises a gradient in particle size as well as in particle volume fraction. Larger particles settle farther and faster into the melt. The presence of simultaneous gradients in volume fraction and particle size may have advantages for certain applications. For the case when particles within a size range are being generated during the centrifugal phase separation, the volume fraction gradient can be designed to contain particles of different sizes over the length of the sample (Case 3).

The formulation of FGMs by centrifugal phase separation is demonstrated by three generic experiments: (a) particles generated throughout the sample by solid combustion caused by uniform heating (thermal explosion method), (b) inert particles settling into a melt, and (c) particles generated within a traveling combustion front ignited at one end of the sample. Several parameters serve as controlling factors for tailoring the properties of the FGM formed by centrifugal phase separation: centrifugal acceleration, particle size and size distribution, particle shape, particle density, melt density, melt viscosity (temperature), centrifugation time, and length of centrifugation chamber.

In addition to the combustion synthesis methods for preparing FGMs, several nonreactive systems are suggested for embedding inert particles as a gradient in a metal matrix. The basic concept is simple: allow particles to be centrifugally driven through molten metal until the desired gradient is achieved, then cool and solidify the metal. The following cases are examined:

1. Metal and ceramic particles are mixed together and placed in a phase-separation chamber. The temperature is raised above the metal melting point, and centrifugation causes movement of the particles through the molten metal.

2. In the chamber (centrifuge tube), a layer of ceramic particles is placed over a layer of solid metal (or metal particles). The temperature of the vessel is raised above the metal melting point, and centrifugal force causes the ceramic particles to settle into the molten metal. The direction of particle motion is determined by the relative densities of the particles and the melt. The different initial conditions of 1 and 2 will in general lead to different gradients.

3. The size and shape of sedimented particles can influence and control the properties of the resulting FGM. Typically, smaller particles will provide smoother gradients and yield more desirable properties. For additional strength, fibrous particles can be sedimented into the metal. For certain applications, it may be desirable to sediment ceramic powder to one end of a sample and fibrous particles to the other end. The densities of the particles relative to the melt determine the direction of sedimentation.

These three cases are presented to illustrate key features of the mathematical model for the phase-separation by centrifugation: (1) particles are initially dispersed in the melt, (2) a layer of particles is introduced at the entrance of the phase-separation chamber, and (3) particles are generated uniformly in the melt. The distribution of particle sizes, for simplicity in explaining basic concepts, is a rectangular distribution (equal number of particles of different sizes up to radius $r_o$).

Case 1

Nongrowing particles ($\Omega=0$) initially are distributed in the phase-separation chamber according to $$f(r;\ z,\ t=0)=f_o(r;\ z) \tag{8}$$

and no particles are generated (G=0). The solution to Eq(9) is:

$$f(r;\ z,\ t)=f_o(r;\ z)\ [1-u(t-z/v)] \tag{9}$$

where the step function is u(x)=1 if x>0 and 0 if x<0. If the initial particle-size distribution is rectangular and uniform (independent of z), i.e., $$f_o(r;\ z)=f_c \text{ for } 0\leqq r\leqq r\ o \text{ and } 0 \text{ for } r>o \tag{10}$$

then the step function in Eq(9, since it depends on $v=\phi r^2$, can be replaced with u(r-r'), where $r'<r_o$ is defined by $$r'^2 = \frac{z}{\Phi t} \tag{11}$$

The interval of integration in Eqs (4) and (5) is thus (r', $r_o$). Performing the integrations and normalizing the volume fraction gives $$E(z,\ t) = \frac{F(z,\ t)}{F(t=0)} = \left(\frac{r'}{r_o}\right)^4 = \left(\frac{z}{t\Phi r_o^2}\right)^2 \tag{12}$$

The deposit density is defined in terms of the depth at infinite time, $h_\infty$, i.e., $F_S=L\ F(t=0)/h_\infty$; one obtains $$h(t) = h_\infty\left[1-\left(\frac{1}{3}\right)\left(\frac{L}{t\Phi r_o^2}\right)^2\right] \tag{13}$$

FIG. 6 shows the volume fraction (composition) gradient and the deposit depth at various times. The volume fraction of particles increases along the length coordinate in proportion to $z^2$. The properties of $Al_2O_3$ particles in molten Al for the centrifugal phase separation are presented in Table I.

Case 2

Figure 7:
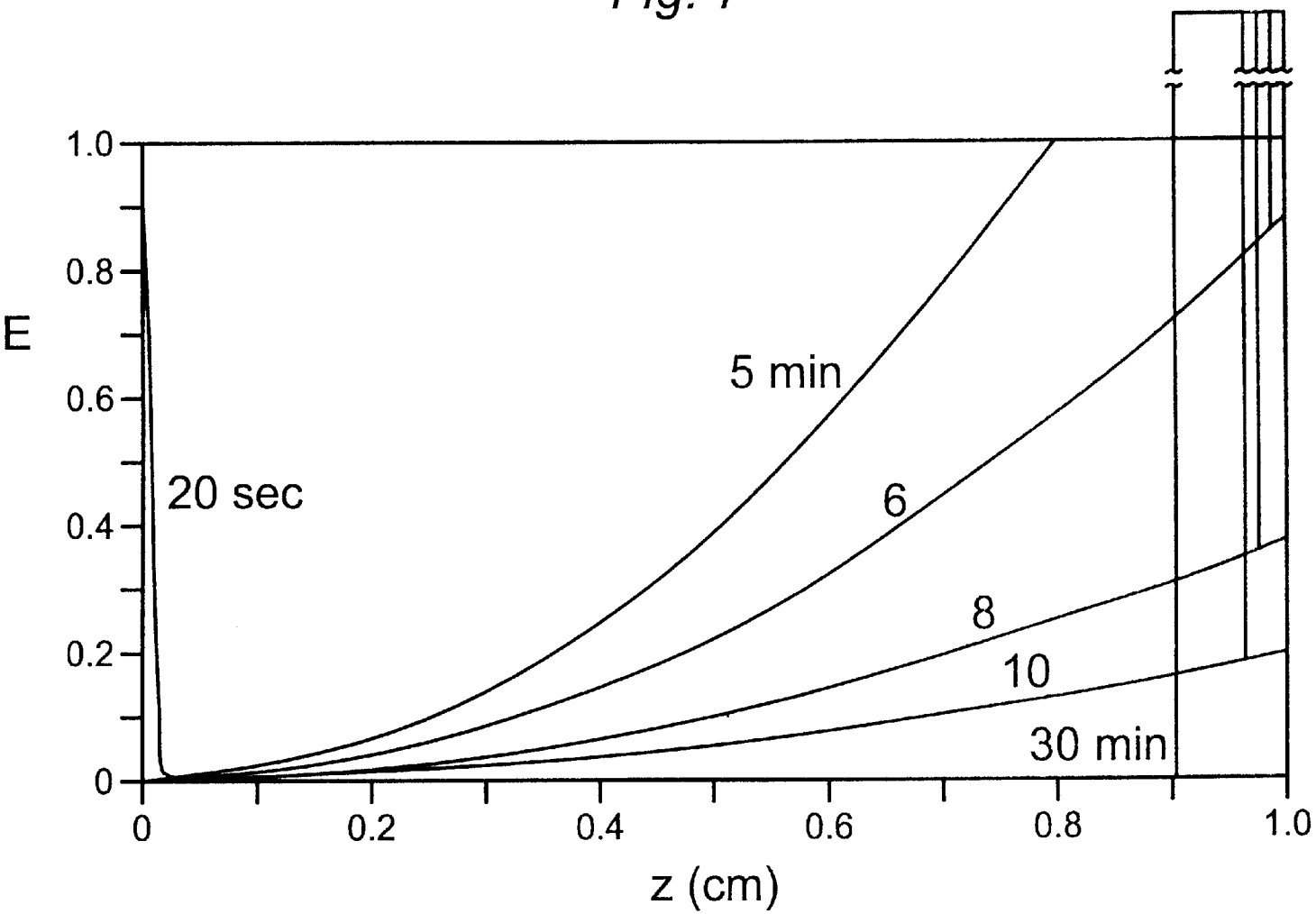
FIG. 7. Calculated gradients for the system Al-$Al_2O_3$, Case 2.

If a layer of particles is introduced at z=0 the governing equation for $\Omega=0$ and G=0 is $$\frac{df}{df} + v\frac{df}{dz} + 0 \tag{14}$$

with the initial condition, f(r, z, t=0)=0. The boundary condition $$f(r;\ z=0),\ t)=f_o(r)\ [u(t)-u(t-t_o)] \tag{15}$$

describes a pulse of particles of duration $t_o$ that enters the phase-separation chamber. The solution can be found by Laplace transformation $$(r;\ z,\ t)=f_o(r)[u(t-z/v)-u(t-t_o-z/v)] \tag{16}$$

and the step functions place limits on the values of r for integrations over r. The volume fraction becomes $$(z,\ t) = \frac{F(t,\ z)}{F_o} = \left(\frac{z^2}{\Phi^2 r_o^4}\right)\left[\frac{1}{(tt_o)^2} - \frac{1}{t^2}\right] \tag{17}$$

with $F_o=(\sigma/3)f_c r_o^4$. The sediment depth can be determined by the same method used for Case 1. The gradient and sediment depth at various times are shown in FIG. 7. At a very early time, the gradient decreases, while at long times the gradient increases in proportion to $z^2$ as the particles make their way to the end of the vessel, where they are deposited.

Case 3

If nongrowing particles are being generated at a constant rate, the governing equation is $$\frac{df}{dt} + v\frac{df}{dz} = G \tag{18}$$

with the initial condition f(r, z, t=0)=0, and the boundary condition f(r, z=0, t)=0. The solution is readily found when the generation term is uniform in space, i.e., G(r, t)

$$f(r, z, t) = \int_o^t G(\tau, r)[1 - u(t - \tau - z/v)]d\tau \tag{19}$$

For a constant generation term defined as $G=G_o$ for $0 \leqq r \leqq r_o$ and 0 for $r>r_o$, the solution simplifies to $$f(r, z, t)=G_o[t-(t-z/v)u(t-z/v)] \tag{20}$$

Relative to $F_o=(2/3)\pi G_o L r_o^2/\phi$, the volume fraction is $$E(z, t) = \left[\frac{\Phi t r'^4}{2r_o^2} + z\left(1 - \frac{r'^2}{r_o^2}\right)\right]L \tag{21}$$

Figure 8:
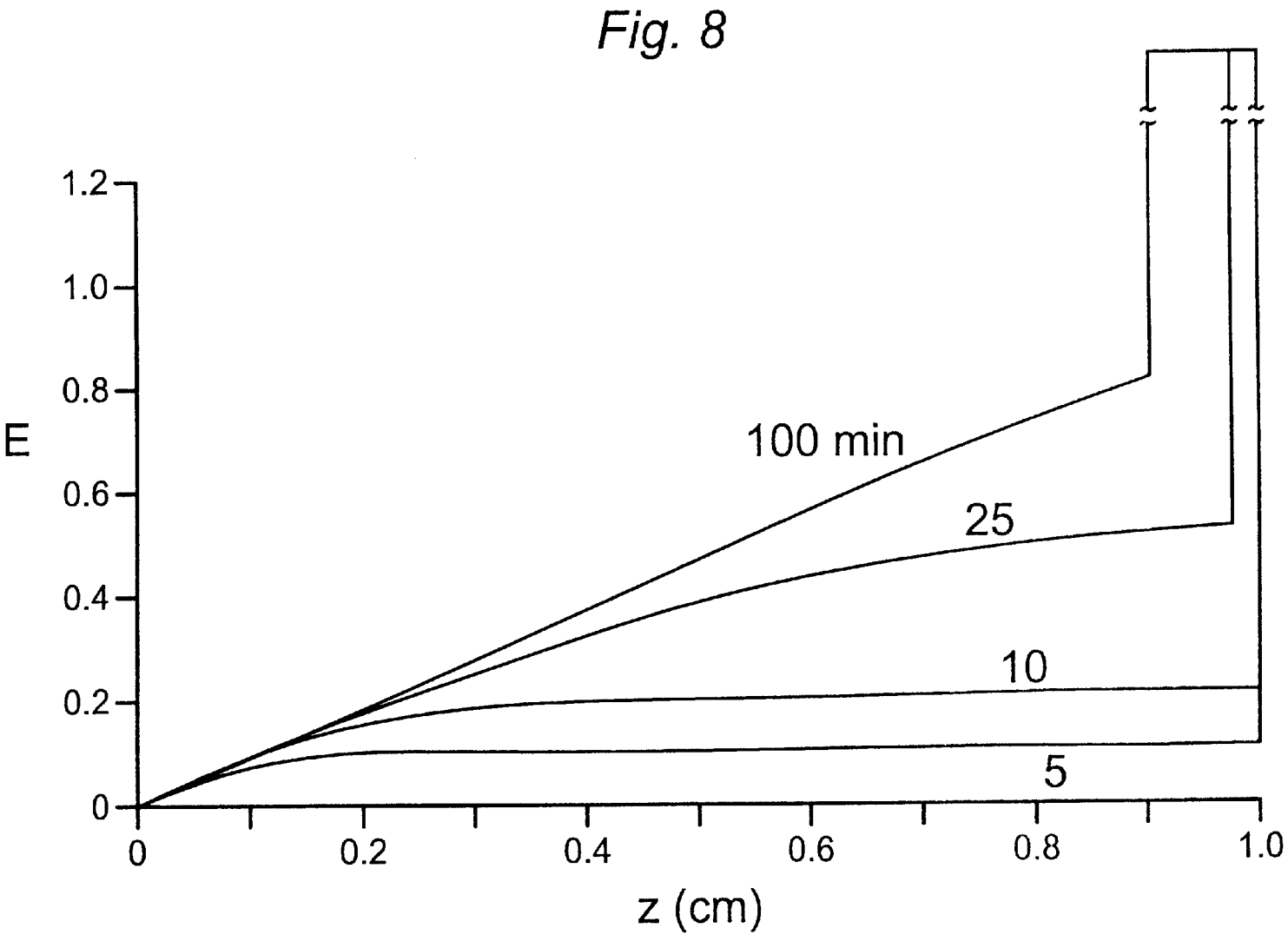
FIG. 8. Calculated gradients for the system Al-$Al_2O_3$, Case 3.

With the substitution of Eq(21) this expression yields the limit E=z/L as t becomes infinite, i.e., the generation rate is balanced by the sedimentation rate, and then the volume fraction increases linearly with the length coordinate. The volume fraction gradient and the sediment thickness are shown in FIG. 8.

These mathematical models permit the properties of the final FGM to be tailored to specification. For any optimization experiment, the parameters that control the gradient of composition are, according to Eq(3), the centrifugal acceleration, g, the time of centrifugation, t, the chamber length, L, the particle size and shape distribution, the particle and liquid densities, and the liquid viscosity (dependent on temperature and composition of the melt). The mathematical model assists in suggesting how these parameters should be selected to optimize the FGM properties.

Preferred systems for these nonreactive centrifugal FGM methods are based on Al (m.p.=660° C.). Due to their high strength-to-weight ratio, aluminum matrix composites are used extensively in automotive and aerospace structural applications at ambient temperatures. A high priority in materials research is to develop aluminum composites for applications at above-ambient temperatures. The need exists to replace existing Ti alloys and stainless steel in engine components. Aluminum-matrix composites with gradient properties can combine the desirable features of strength, wear-resistance, temperature stability, and toughness. The method of the present invention is used to make aluminum-matrix FGMs with embedded gradients of either C, SiC, or $Al_2O_3$. Whiskers or particles of these and other ceramics are readily available. For higher temperature applications titanium or nickel comprises the metal matrix.

The calculations presented above are based on a simplified mathematical model, and are included for illustration purposes. This rudimentary picture of FGM manufacture by centrifugal phase separation provides qualitative insight into the key variables and fundamental processes. A realistic mathematical model to describe in detail the results of optimization experiments will likely be considerably more complex. The following extensions are suggested:

a. The particle size distribution will be generalized to:
   i. a linear distribution $f_o(r)=f_c(1-r_o)$ for $r<r_o$ and 0 for $r>r_o$;
   ii. an exponential distribution, $f_o(r)=f_c \exp(-r/r_o)$;
   iii. a gaussian distribution, $f_o(r)=f_c \exp[-r-ro)^2/2\pi]$.

b. The growth term will be generalized to:
   i. a linear distribution, $G_o(r)=G_c(1-r_o)$ for $r<r_o$ and 0 for $r>r_o$;
   ii. an exponential distribution, $G_o(r)=G_c \exp[-r-r_o)$,
   iii. a gaussian distribution, $G_o(r)=G_c \exp[-(r-ro)^2/2\sigma]$.

c. The growth term will be incorporated, e.g., based on diffusion theory for particle growth, and expressions for Ω will be included in the population balance equation (Eq2).

d. Embedding of rod-shaped particles (fibers) in the FGM will be considered.

e. Particle interactions (hindered settling by Kynch theory) will be applied to the quantitative description of centrifugal production of FGMs.

f. Simultaneous phase separation of light and heavy particles will be considered: particles heavier than the melt will move with the centrifugal force, and particles lighter than the melt will move opposite to the centrifugal force.

Preliminary experiments whose aim was to demonstrate the feasibility of establishing a compositional gradient by the centrifuge-assisted combustion synthesis method have been conducted. A thermite reaction ($2NiO+Zr=2Ni+ZrO_2$) was initiated in a thermal explosion method while the system was under the effect of a 50 $g_o$ centrifugal force. X-ray analysis of the product showed a clear separation of the phases (metal and oxide). The ratio of intensity of the peaks $$(I_{Ni} / I_{ZrO_2})$$

changed by more than a factor of two from one end of the sample to the her, with intermediate values in between. Other systems (e.g., CuO+Zr) were also examined with the results, again, showing clearly that a compositional gradient can be established under the action of a gravitational force.

As shown above (Eq(3)), phase distribution can be examined through calculations of the distance of travel of a solid particle in a liquid phase, i.e., $$x = \frac{2}{9}(\rho_1 - \rho_2)\frac{g}{\mu} \cdot r^2 \cdot t \tag{22}$$

Direct control over the parameters g and $\rho_1$ and $\rho_2$ can be made and indirect control over t and $\mu$ can be attained through changes in the experimental conditions (higher combustion temperatures lead to higher t values and lower $\mu$ values). Control of the particle size is not possible in a direct way. However, as in the classical nucleation and growth phenomena, particle size depends on the degree of supercooling and is, therefore, expected to be influenced by the rate of cooling of the sample which in turn is affected by the rate of heat loss. The latter can be altered experimentally by changes in the thermal insulation of the sample. Experimental evidence has been provided showing that higher heat losses associated with convective phenomena under high $F_c$ results in smaller particle size of a solid carbide phase {A. G. Merzhanov, et al., supra}. Higher heat losses resulted in mixed carbide particles ($TiC+Cr_3C_2$) of sizes in the range 3–4 $\mu$m. When heat losses were not large, the particles were in the size range 10–20 $\mu$m. It should be emphasized that differences in heat loss in these two cases were a direct consequence of the application of a gravitational force.

The effect of a density difference provides an interesting area of development, with the following system as an example:

$$CrO_3+(2+x)Al=Al_2O_3+CrAl_x \tag{23}$$

The density of alloy product ($CrAl_x$) depends on its composition (i.e., the value of x) and can be changed such that it can be greater or lower than that of $Al_2O_3$ ($\rho$=3.5 g. $cm^{-3}$). It has been observed that with lower values of x, the oxide ($Al_2O_3$) separates at the top and with higher values of x, $Al_2O_3$ separates to the bottom {A. G. Merzhanov, et al., *Proceedings of the First US-Japan Workshop on Combustion Synthesis,* Jan. 11–12, 1990, Tsukuba Science City, Y. Kaieda, et al. (eds.), National Research Institute for Metals, Tokyo, p. 1}. At intermediate compositions no phase separation has been observed. The effect of a centrifugal force on phase distribution in systems near this intermediate range is investigated. With a small difference between $\rho_1$ and $\rho_2$ the effect of the gravitational force can be clearly ascertained.

The fundamental aspects of gravitational-force enhanced phase distribution were explored in another system, namely, $$a(Ti+C)+b(xNi+yAl)=aTiC+bNi_xAly \quad (24)$$

Figure 9:
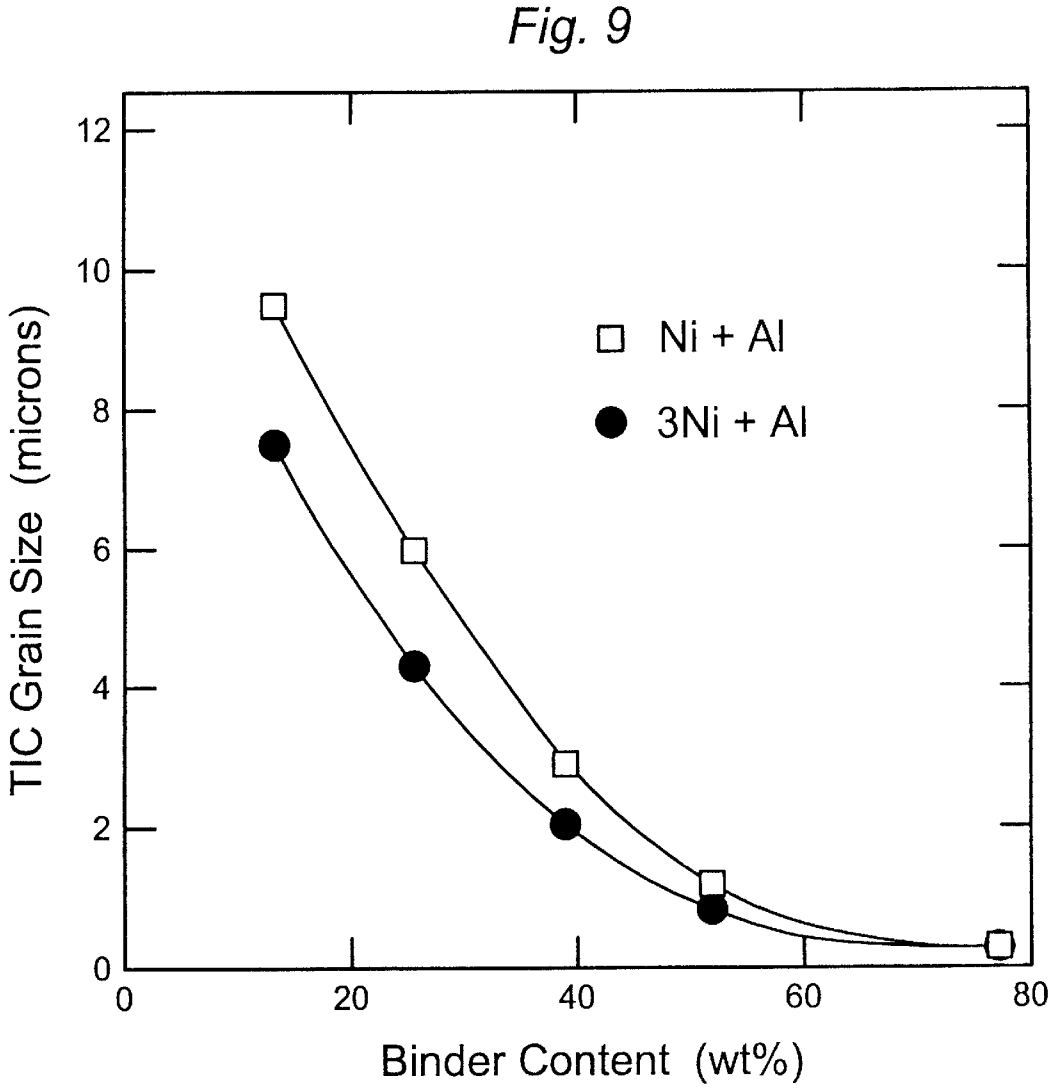
FIG. 9. The influence of metallic content (binder) on the TiC particle size in a TiC-NiAl and TiC-$Ni_3$Al composite synthesized by combustion {S. D. Dunmead, et al., *Journal of Material Science,* 26:2410-16 (1990)}.

The effect of the metallic content (ratio of b/a) and the composition of the metal phase (ratio of x/y) on the property of the product has already been examined {S. D. Dunmead, et al., *Journal of Materials Science,* 26:2410-16 (1990)}. It was demonstrated (see FIG. 9) that the particle size of the ceramic phase (TiC) depended on the ratio b/a: higher ratios resulted in smaller particles. This system was investigated under a centrifugal force to ascertain the predicted effect of particle size on the phase distribution in the resulting functionally gradient material. The ratio b/a dictates primarily the combustion temperature but the ratio x/y influences the lowest temperature at which a liquid phase is possible. Thus, changes in both ratios can be used to alter the parameter of t and r in Eq(22).

Different chemical systems can be selected to provide fundamental data on the synthesis of ceramic-ceramic FGM composites as distinct from ceramic-metal composites discussed above. Shown in Eq(25) is a modified thermite reaction to synthesize $Mo_2C$ and $Al_2O_3$:

$$2MoO_3+4Al+C=Mo_2C+2Al_2O_3 \quad (25)$$

For this reaction, the calculated adiabatic temperature (4220° C.) is above the boiling point of $Al_2O_3$ (2980° C.). However, by the addition of $Al_2O_3$ as an inert diluent the combustion temperature may be reduced below 2980° C. but still above the melting point of $Mo_2C$ (2687° C.). Therefore, over a certain temperature range it is possible to have two liquids. The final structure of the product is determined by the miscibility of these liquids at elevated temperatures. By adding larger amounts of $Al_2O_3$ to the reactant mixture, the temperature can be reduced so that the products at the combustion temperature consist of solid $Mo_2C$ and liquid $Al_2O_3$. The rate of nucleation and growth of the carbide particles is governed by the sequential reactions: (1) $2MoO_3+4Al \rightarrow 2Mo+2Al_2O_3$ and (2) $2Mo+C \rightarrow Mo_2C$. The compositional gradient in the FGM is established by the same experimental parameters as discussed above. Because of the exothermicity of this reaction (Eq(25)), significant material loss is encountered through small explosions (spatter). The effect of the centrifugal force could modify the magnitude of this phenomenon.

The work described above is carried out under two general combustion synthesis modes: thermal explosion and wave propagation {Munir (1988), supra}. Under the former condition, the entire sample is heated up to a temperature when the reaction occurs simultaneously throughout the sample. This condition provides for liquid formation, and hence phase separation, throughout the sample. Phase distribution, therefore, can occur across the entire sample as long as a liquid phase is present. The latter consideration (presence of a liquid phase) is governed by the combustion temperature, the nature of phase equilibria in the system under investigation, and by heat loss.

Under the wave propagation mode, the samples are ignited at one end and a combustion front allowed to propagate. The effect of a centrifugal force on phase distribution for the case of a wave propagating in the same direction and in the opposite direction to the force of acceleration will differ. Under a wave propagation mode, the presence of a liquid phase would be primarily restricted to the wave front and thus phase separation is also restricted to that region. Therefore, in addition to the other parameters mentioned above, the velocity of wave propagation becomes a factor governing phase distribution. That phase distribution is possible under a wave propagation mode has been shown experimentally {A. G. Merzhanov, et al., supra}; however, the effect of the direction of the wave relative to the force of acceleration has not been investigated. It is expected that this effect will depend on the density of the (solid) particles relative to the density of the liquid phase. In this regard, the system described by Eq(23) offers the potential for controlling this effect by varying the value of x.

Although so far chemical compositional gradient in FGM has been emphasized, this work can be extended to examine the effect of a centrifugal force on the distribution of porosity in combustion synthesized materials. As indicated above, there is experimental evidence that the size distribution of pores is influenced by a 1 $g_o$ gravitational field in nickel-aluminum alloys {Hurst, supra}. In principle, distribution of porosity is governed by the same theoretical criteria as those applicable to phase separation and the prospect is there that gradients of pores with given size and number distributions can be effected through the proposed research. Among other areas, materials with porosity gradients are of interest in biological (e.g., dental) implant applications {M. Kibrick, et al., *Journal of Oral Implants,* 6:172 (1975); Idem, ibid, 7:106 (1977)).

Figure 10A:
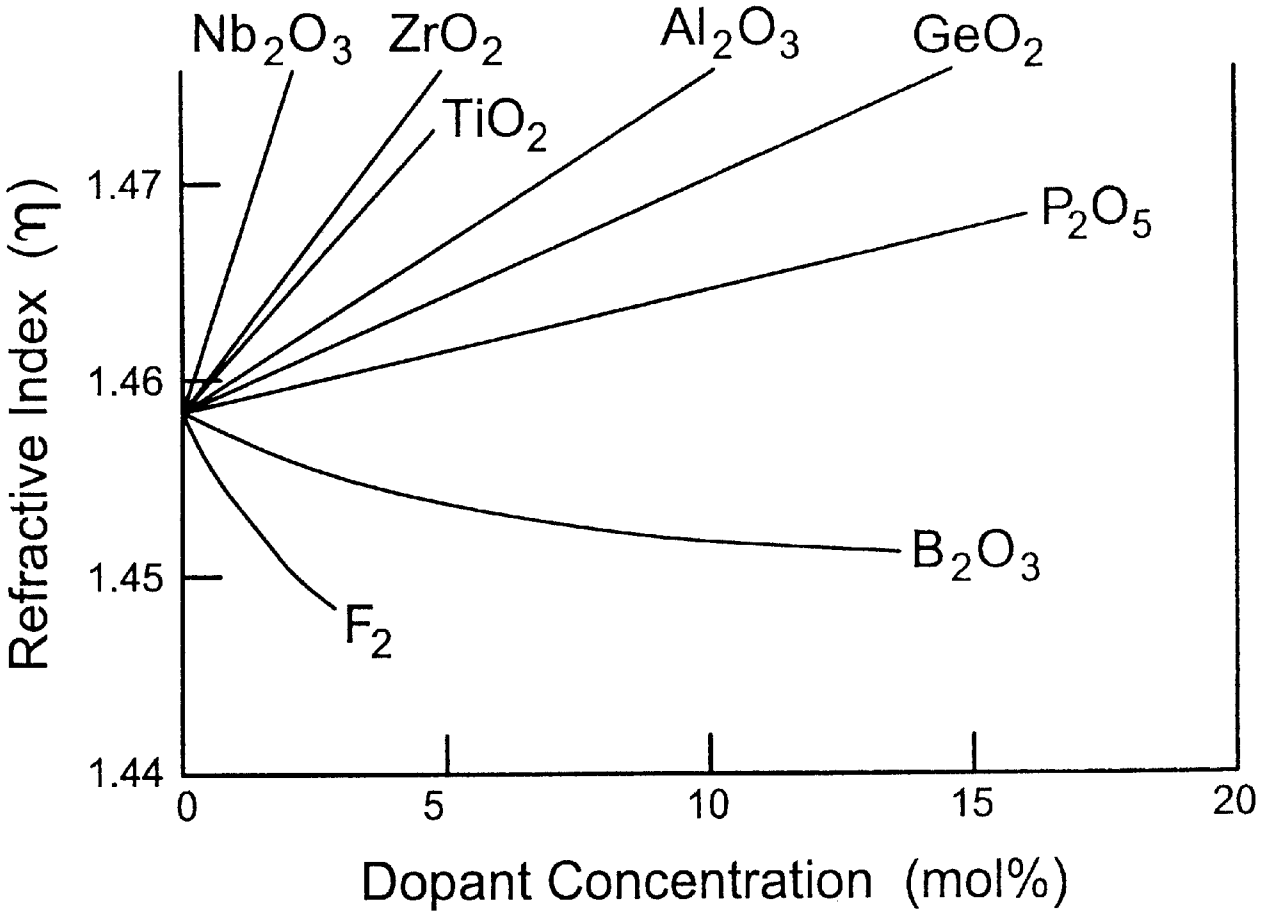
FIG. 10. The effect of dopant concentration in silica glasses on (a) the refractive index, and (b) the thermal expansion coefficient.
Figure 10B:
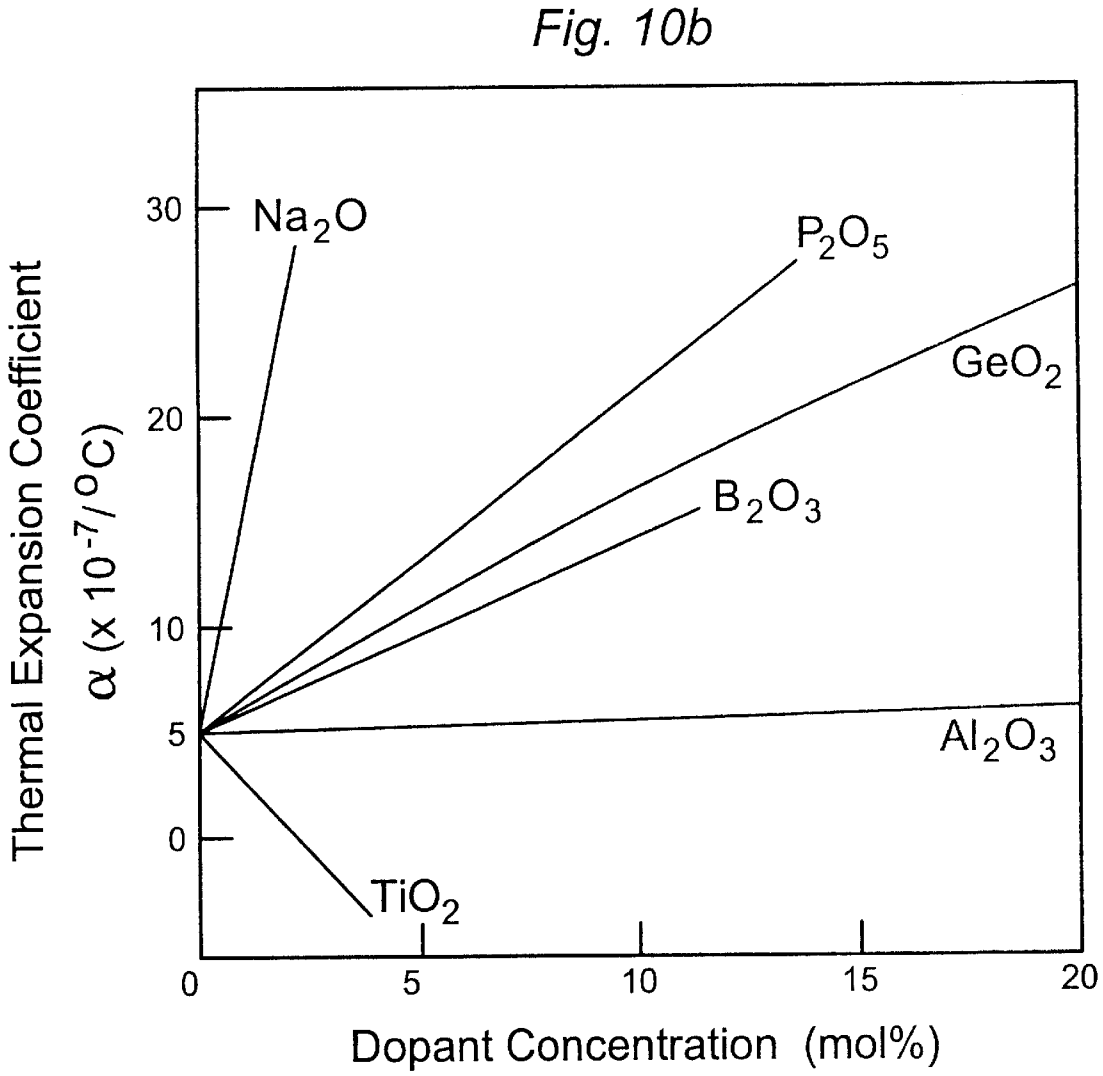

The FGM processing of $SiO_2$-$TiO_2$ compositions for use in electro-optic FGM systems was also investigated. It is well known that very low attenuation silica glasses with dopants ($TiO_2$, $P_2O_5$, $GeO_2$, etc.) can alter the refractive index of bulk glasses used for fiber optic communication systems. Ti $O_2$ and $Nb_2O_5$ are especially effective in causing a steep increase in the refractive index, and $TiO_2$ additions (at levels of up to 5 mole %) also decrease the thermal expansion coefficient of the glass (see FIG. 10). Binary silica glasses (with $TiO_2$, $GeO_2$) and ternary systems have been developed for GRIN optics. Gel-derived leached glasses are usually sintered to dense components (typically rods 3 mm diameter by 10 mm long) with $\Delta n$ up to 0.1 (maximum). In the present research $SiO_2$-$TiO_2$ powders are blended in various amounts and prepared for centrifugally-assisted FGM processing. Powders are charged into graphite molds and centrifugally accelerated to create multi-gravity (20–50 $g_o$) environments. At the same time, the sample is heated to temperatures in excess of 1750° C. in a chemical oven (heat supplied by a combustion reaction of, e.g., Ti+C) {U. Anselmi-Tamburini, et al., *Journal of Applied Physics,* 66:5039 (1989)}. This temperature exceeds the melting point of $SiO_2$ (~1725° C.) but not that of $TiO_2$ (~1850° C.). $TiO_2$ particles suspended in the viscous $SiO_2$ rich melt start settling due to the high g environment of the melt ($\rho$ for $TiO_2$=4.0 g. $cm^{-3}$ and $\rho$ for $SiO_2$=2.2 g. $cm^3$). These processing conditions thus create a melt with a gradient in the concentration of $TiO_2$ varying from almost pure $SiO_2$ at one end to 10 to 15 wt % $TiO_2$ at the other. The solubility of $TiO_2$ in liquid $SiO_2$ at the processing temperature of 1750° C. is limited to ≈18 wt % (to maintain a single phase liquid). The process of rapid $TiO_2$-$SiO_2$ liquid formation is assisted by a eutectic in the phase diagram at ≈1550° C. The settling and parallel reactions of $TiO_2$ particles in the $SiO_2$ rich melt occur quite rapidly in the FGM process and a composition profile develops in the melt due to the high g environment. Subsequent cooling of the melt gives a macroscopic glass blank with a gradient in refractive index because of the $TiO_2$ concentration gradient.

The FGM synthesized bulk $SiO_2$-$TiO_2$ samples is analyzed for microchemical composition and optical properties. Electron beam microprobe analysis for composition is performed at 10 μm intervals to obtain a composition profile of each sample. Parallel refractive index profiles are obtained by standard interferometric methods. Interference fringes across the sample provides point to point refractive index data. A key variable in the settling of $TiO_2$ particles due to the FGM centrifuge processing is melt viscosity. Since viscosity has an exponential dependence on temperature, several test temperatures (in the range of 1750 to 1850° C.) are attempted to determine the effect of viscosity on composition gradient.

Quantum dot electronic materials processing by FGM involves the same procedure but the system chosen is a special composition of a silicate glass mixed with CdSe particles. Following FGM processing in the centrifuge, samples are evaluated for optical absorption and non-linear response. The microstructure of these materials is also studied by TEM techniques using High Voltage Electron Microscopy (HVTEM).

One of the advantages of FGM systems is that they provide a workable alternative to layered structures with regard to thermal stresses. It is, therefore, not surprising that considerable attention has been focused on this area. Investigations on thermal stress included the optimal design of FGM to reduce stress {T. Hirano, et al., *Proceedings of the International Symposium on Space Technology and Science,* Sapporo, Japan (1988)}, and the application of elasticity theory and finite element analysis to determine the effects of thermal mismatch in a composite {O. Kimura, et al., *Proceedings of the First International Symposium on FGM,* M. Yamanouchi, et al. (eds.), p. 359 (1990); M. Sasaki, et al., ibid, p. 83}. It has been shown that the thermal expansion coefficient of a TiC-SiC composite is nearly a linear function of composition {C. Kawai, et al., ibid, p. 77}.

Different analytical techniques have been utilized to assess the extent and location of thermal stress in FGM {Kawai et al., supra}. These include the use of x-ray diffraction for surface stress determination and the use of SEM to observe thermally-generated cracks. The functionally graded material prepared in accordance with the present invention is characterized with regard to thermal stress by utilizing a well established technique {Sasaki, et al., supra}. Specimens are cooled with liquid nitrogen at one end and heated by an infrared lamp at the other through a cyclic mode. At different intervals the specimens are examined microscopically for crack formation. The results obtained from these investigations are compared to those obtained from another set of experiments in which FGM is made by combustion synthesis using the "layered" approach.

EXAMPLE 1

The following example shows the use of centrifugal force during combustion synthesis to obtain functionally-graded materials. Composites formed by the reaction 2Al+CuO=$Al_2O_3$+(3+x)Cu were synthesized in a centrifuge. The effects of diluent content, x, relative density of the reactants, and the particle size of CuO were investigated. Graded zones between the ceramic and metallic phases were obtained under a given set of these parameters. Phase separation times were calculated from sedimentation theory and discussed in light of experimental observations.

I. EXPERIMENTAL MATERIALS AND METHODS $Al_2O_3$/Cu composites were synthesized via the thermite reaction, $$2Al+3CuO+xCu \rightarrow Al_2O_3+(3+x)Cu \quad (26)$$

In Eq(26), x represents the amount of copper diluent added to the thermite reaction, and had values of 4, 6, 7 and 8. The aluminum powders used were 99.5% pure and had a sieve designation of −325 mesh. Two powders of CuO were used. The first had a purity of 99.99% and a particle size range of 43–841 μm, while the second was 99+% pure with a particle size of <5 μm. The copper (diluent) powders were 99% pure and had a sieve designation of −325 mesh. For the stoichiometric ratios indicated in Eq(26), powders were mixed and the samples were prepared in two ways. In one method the powder were pressed to form cylindrical pellets (1 cm in diameter and 1 cm high) with a relative density of 55%. The resulting pellets were placed in a graphic cylinder, which was subsequently placed inside a furnace. The second method of sample preparation involved pouring loose powder mixtures directly inside the graphite cylinder. These powders were either shaken to give a relative density of 37%, or were left as poured resulting in a relative density of about 20%.

The graphite cylinder containing the sample in either form (pellet or loose powder), was placed inside a specially designed furnace. The sample assembly was covered with insulation and placed inside a large ceramic container equipped with an inlet and outlet for argon gas flow. The entire set-up was positioned inside the working arm of a centrifuge. The centrifuge used for this study has a one meter-long arm holding the "working budget". A second arm provided the counter-balance. The maximum centrifuge acceleration, g, is 100 $g_o$, where $g_o$ is the gravitational acceleration. The entire sample enclosure was purged with argon gas before staring a centrifuge experiment. When the acceleration reaches the desired g level, the process of heating sample is initiated. The temperature was raised to the ignition point, which for Eq(26) is around 900° C. Argon gas flow is maintained until the sample temperature has decreased to near room temperature.

After being removed from the centrifuge, samples were examined and analyzed by optical microscopy, scanning electron microscopy (SEM), x-ray mapping, computerized image analysis, and x-ray diffraction analysis (XRD).

II. RESULTS AND DISCUSSION

Figure 11:
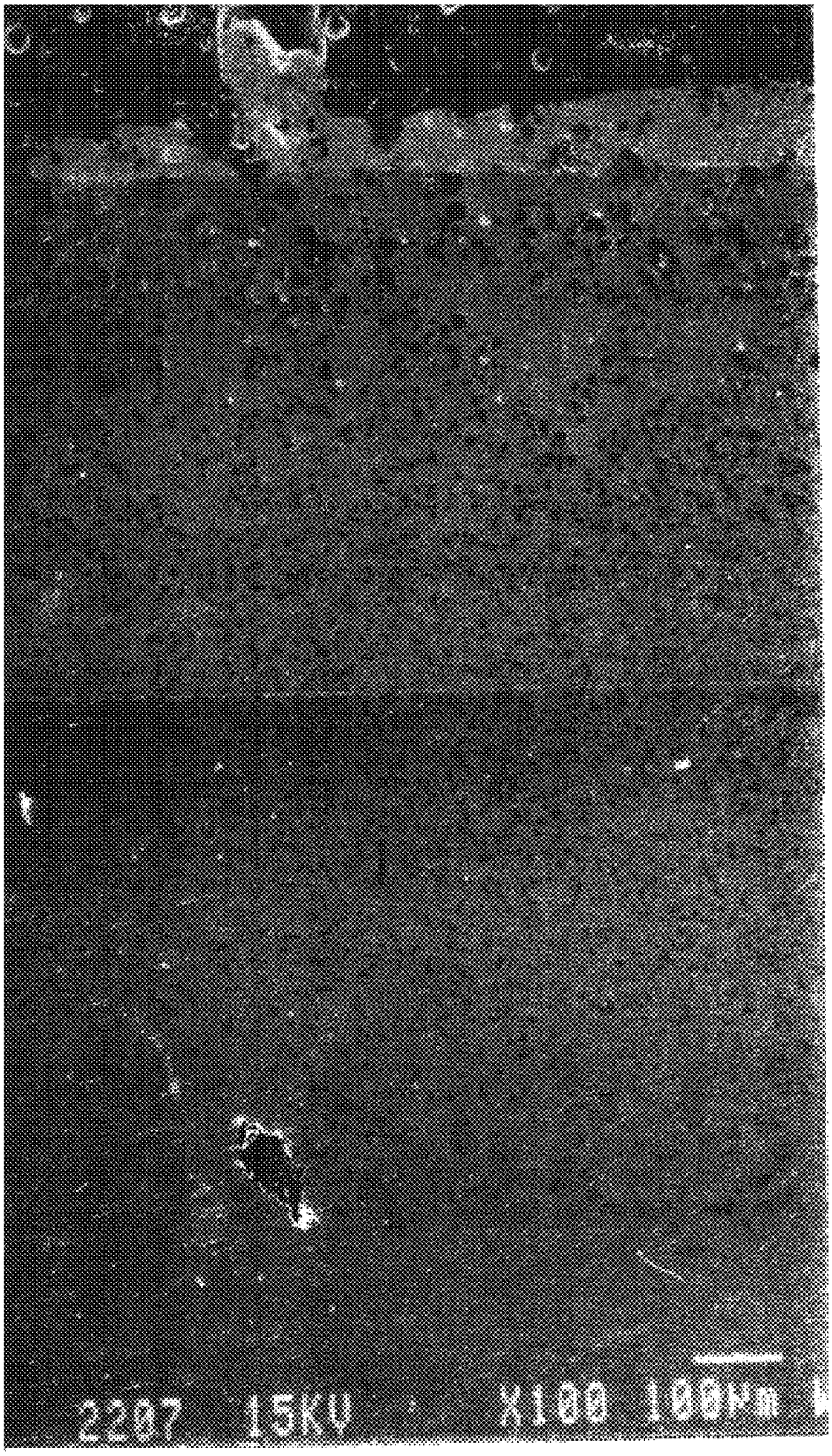
FIG. 11. SEM micrograph of graded $Al_2O_3$/Cu region ($Al_2O_3$:Dark, Cu:Gray)
Figure 12:
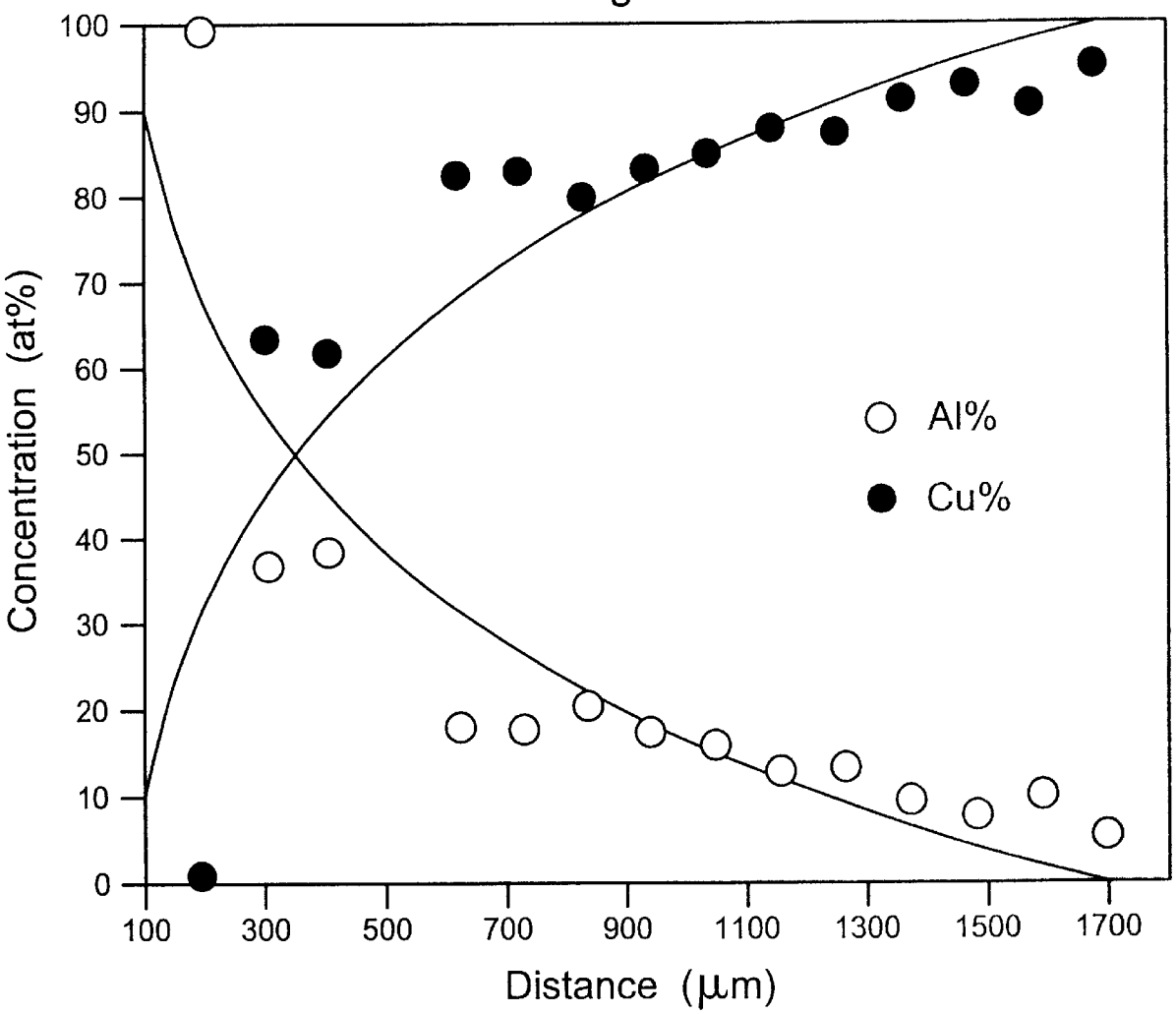
FIG. 12. Microprobe analysis of Al and Cu across the compositionally graded region.

When the reactants of Eq(26) were in the form of a compacted pellet (55% relative density), the product contained non-segregated $Al_2O_3$ and Cu phases dominated by an interconnected ceramic structure. However, when the reactants were in the form of a loose powder (37% relative density), the results were significantly different. For x=6 or 7, the product contained three regions. The bottom region was dense Cu, the top region was relatively, porous $Al_2O_3$, and in between these there was a transition region showing a graded composition. FIG. 11 shows an SEM micrograph of the graded region between the ceramic and metallic phases for the reaction (Eq(26)) with x=6. Nearly spherical $Al_2O_3$ particles are distributed according to size, with the largest near the boundary between the transition region and the ceramic region. The transition region and the metallic region (Cu) are nearly fully dense while the ceramic region contained porosity, as can be seen in FIG. 11. A microprobe analysis of the compositional change between the upper and lower ends of the FGM zone (transition region) is shown in FIG. 12. The atomic concentration of Cu increases from zero at the upper interface of the FGM zone to nearly 100% at the lower interface. The aluminum concentration has an opposite trend, decreasing from 100% at the upper interface to nearly zero at the lower interface.

Figure 13:
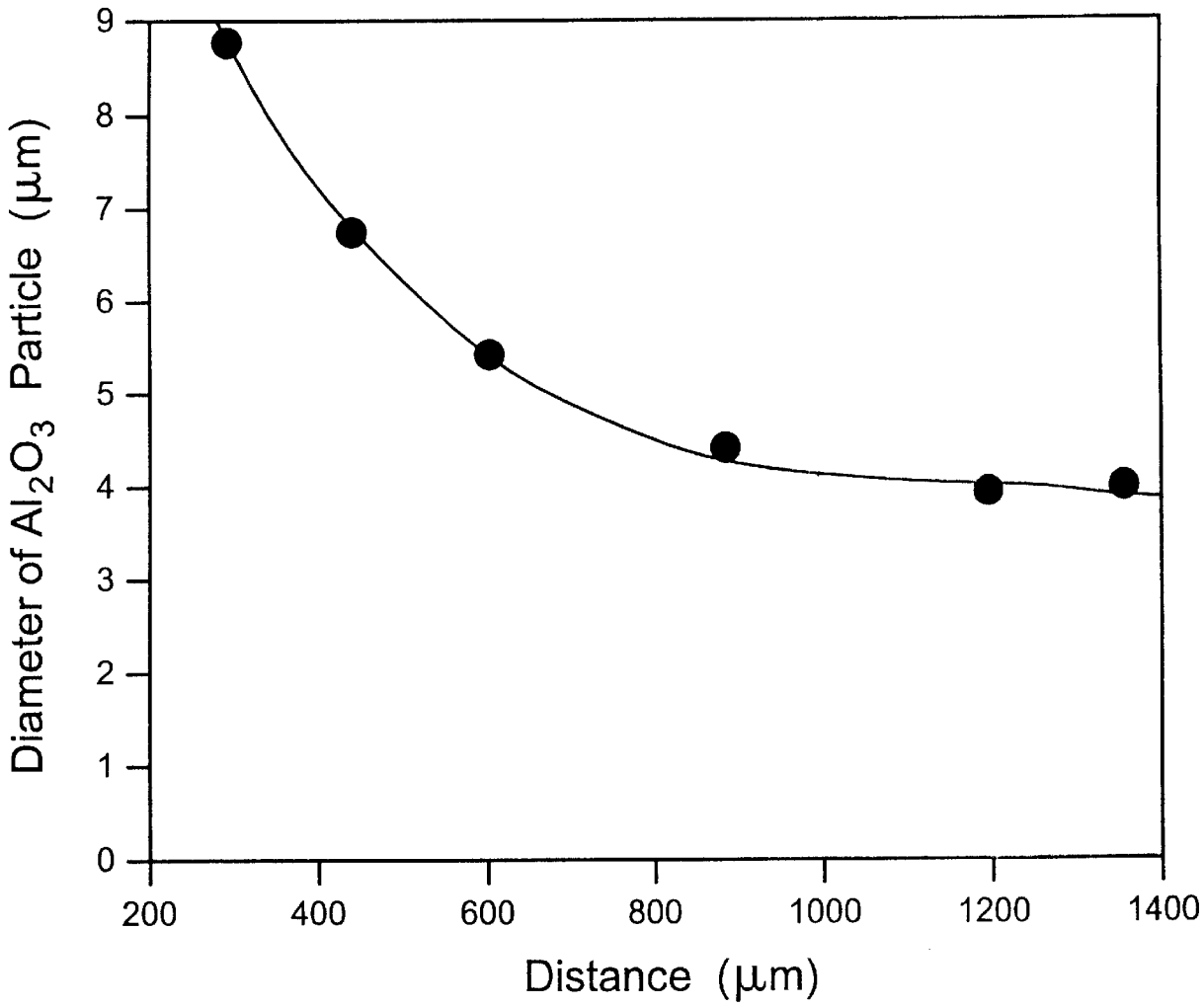
FIG. 13. $Al_2O_3$ particle size distribution within the graded zone, x=6.
Figure 14:
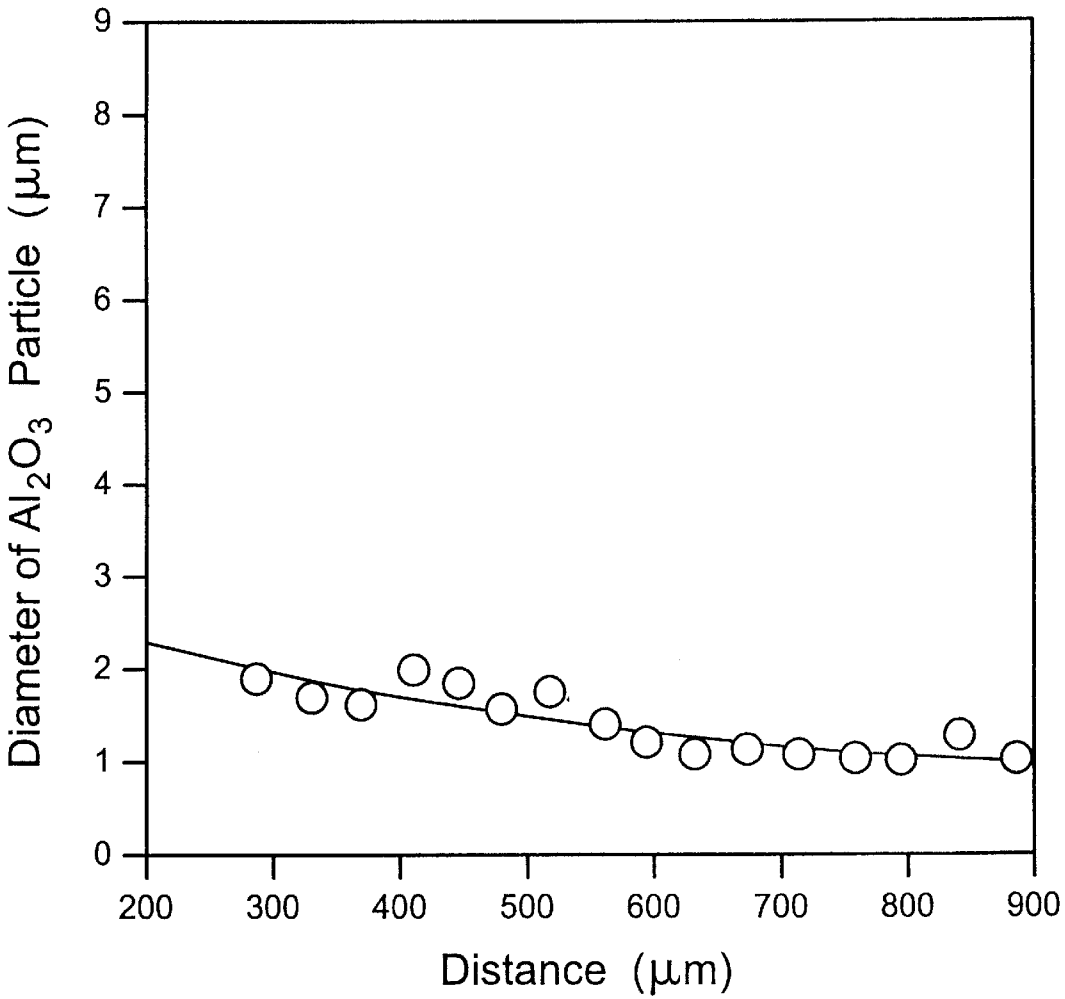
FIG. 14. $Al_2O_3$ particle size distribution within the graded zone, x=7.

A graded distribution of the ceramic particles for the case of x=7 was also obtained. However, a major difference between the two cases relates to the size of the alumina particles. The difference between the two systems can be better demonstrated by plots of $Al_2O_3$ particle size distributions for the two cases. These are seen in FIGS. 13 and 14 for x=6 and 7, respectively. The plotted results were obtained by a computerized image analysis where the average particle size was determined in layers sectioned successively within the FGM zone. In both cases, the particle size decreased by a factor of two from the ceramic side to the metallic side in the FGM zone. However, the $Al_2O_3$ particles in the x=6 system are significantly larger and their distribution varies inversely with distance cubed, as contracted to a nearly linear function for the case with x=7. The difference in particle size between the systems (x=6 and x=7) is attributed to two related factors: combustion temperature and alumina content. For x=6, the adiabatic combustion temperature is 2694K and for x=7, the corresponding value is 2511K Obviously, the $Al_2O_3$ content is also lower for the case of x=7. Both of these factors favor the growth of larger alumina particles for the case of lower dilution (i.e. x=6).

As was pointed out earlier, when compacted powders (55% relative density) were used, the product showed a network of inter-connected ceramic particles and no compositional gradient. With powders having a relative density of 37%, the product contained an FGM zone as described above. With the use of powders with a still higher porosity (relative density of about 20%), the produce consisted of totally segregated ceramic and metallic phases. It is not clear whether these observations are related to the possible role of porosity in sweeping the ceramic phase to the top or they are the consequence of the larger ceramic interparticle distance in the product. At this point the role of porosity in the process of formation of FGM's through a centrifugally-assisted method is not clear.

III. ANALYTICAL EVALUATION OF FGM FORMATION IN A CENTRIFUGAL FIELD

The analysis of the $Al_2O_3$ particle size distribution within a matrix of copper resulting from a centrifugally-assisted thermite reaction was made utilizing the population balance equation {D. M. Himmelblau, et al., "Process Analysis and Simulation-Deterministic System", Wiley, Chap. 4 (1968)}.

$$\frac{\partial f}{\partial t} + \frac{\partial (vf)}{\partial z} + \frac{\partial (\Omega f)}{\partial r} = A \tag{27}$$

where f is the particle size distribution function, v is the particle terminal velocity, Ω is the growth rate of the particle, A is the net generation rate of particles, t is time, r is the particle radius, and z is distance. Application of Eq(27) is based on the following simplifying assumption: (a) the separation process begins immediately following the initiation of the reaction, (b) small-sized nuclei form in the homogeneous low density pellet first, then the sample shrinks to the high density product. Thus the nucleated particles are assumed to experience no growth during the densification stage because of its short duration. We consider the formation of larger particles to be the consequence of particle agglomeration. With these assumptions, a Laplace transformation of the population-balance model gives the relationship of the initial particle size distribution function, $f_o$, to the final distribution function, as:

$$f(r, z, t) = f_o(r, z)[1 - U(x)] \tag{28}$$

where x=t−z/v. The term U(x) is a step function with U(x)=for x>o (t>z/v) and U(x)=o for x<o (t<z/v). In Eq(28), v is the terminal velocity of the particle, t is time, and z is distance. Assuming $f_o$ to be in the form $$f_o(r) = br^a \tag{29}$$

the expressions for the volume fraction of particles in the sample, $F_o(z, t=o)$ and F(z, t) are:

$$F_o(z, t = o) = \frac{4\pi}{3}\int_{r_m}^{r_M} r^3 br^a \, dr = \frac{4\pi b}{3(4+a)}(r_M^{4+a} - r_m^{4+a}) \tag{30}$$

$$F(z, t) = F_o - \frac{4\pi}{3}\int_{r_s}^{r_o} br^a \, dr = F_o - \frac{4\pi}{3(4+a)}(r_M^{4+a} - r_z^{4+a}) \tag{31}$$

Normalization of the volume fraction (at any t) relative to the initial value gives $$E = \frac{F}{F_o} = 1 - \frac{r_M^{4+a} - r_z^{4+a}}{r_M^{4+a} - r_m^{4+a}} \tag{32}$$

where $r_M$ and $r_m$ are the maximum and minimum particle size, respectively, and $r_z$ is defined by $$r_z = \left(\frac{L - z}{\phi t}\right)^{1/2} \tag{33}$$

where L is the length of the graded zone, t is time, and ϕ is defined by Stokes' law as $$\phi = \frac{v}{r^2} \tag{34}$$

The terminal particle velocity, $V_1$ is in turn defined by $$v\frac{2}{9}(\rho_s - \rho_l)\frac{g}{\mu}r^2 \tag{35}$$

where $\rho_S$, $\rho_l$, are the densities of the solid ($Al_2O_3$) and liquid (Cu) phases, respectively, g (=$ag_o$) is the centrifugal acceleration, $\mu$ is the liquid phase viscosity, and r is the particle radius.

Figure 15A:
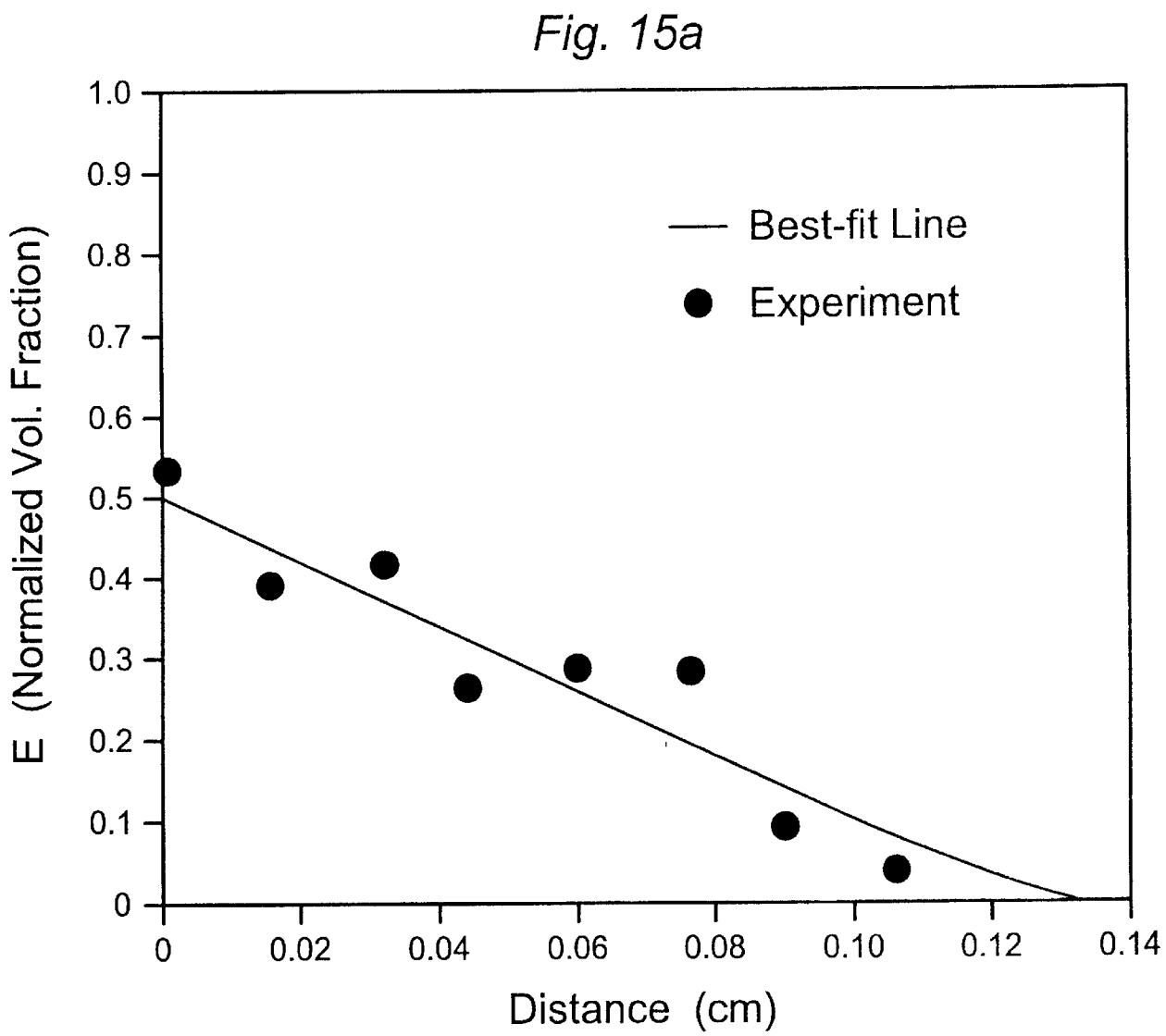
FIG. 15. (a) Normalized volume fraction of $Al_2O_3$ particles with the graded region, x=6; and (b) Normalized volume fraction of $Al_2O_3$ particles with the graded region, x=7.
Figure 15B:
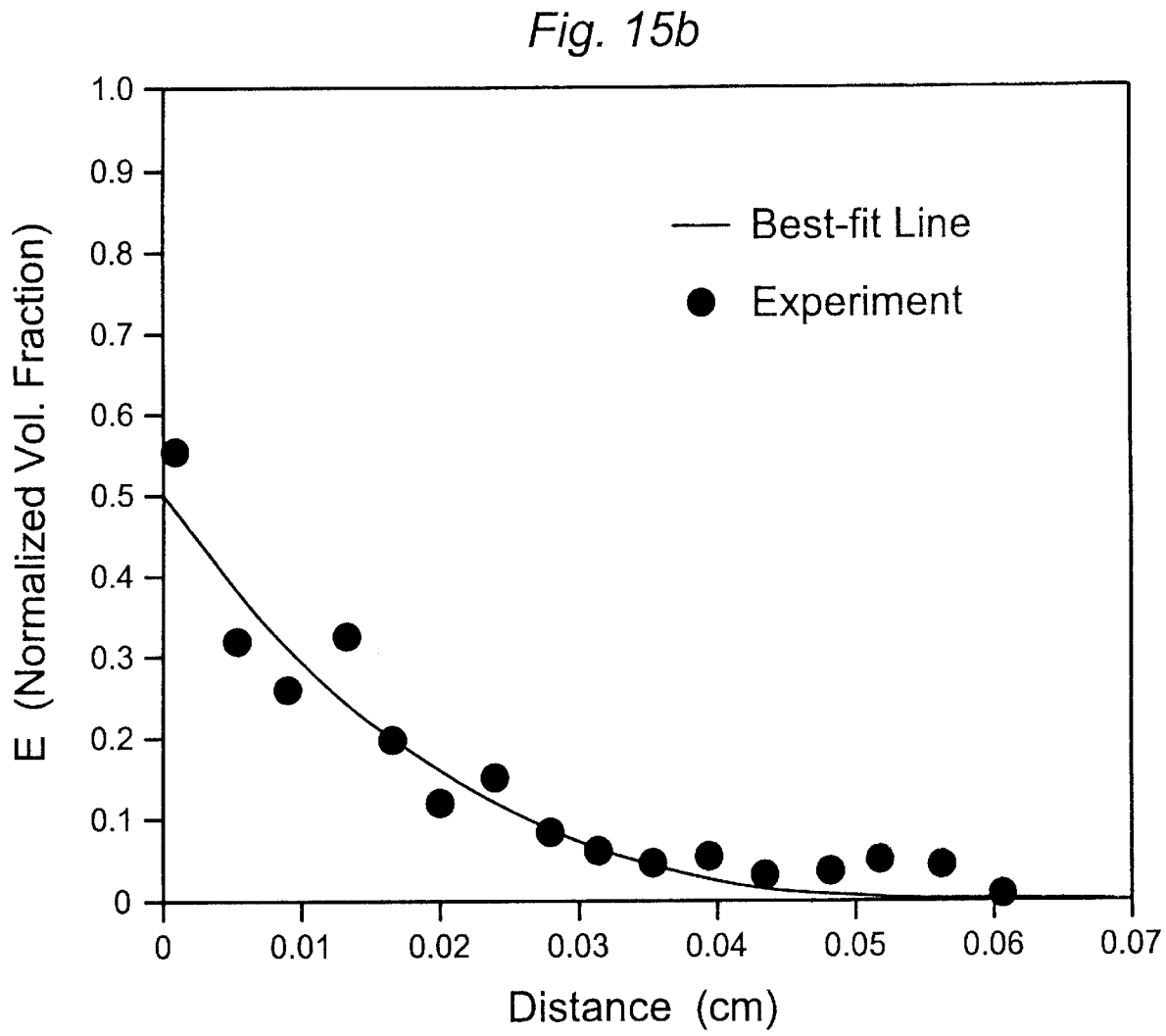

The normalized volume fraction, E, can be calculated from experimental results. The calculation requires knowledge of $F_o(z, t)$ and $F_o(z, t=0)$ at any given z value. The former can be obtained from image analyses of sections of samples (i.e. at various z values). However, $F_o$ cannot be determined experimentally but an appropriate value can be calculated from the initial stoichiometry, Eq(26), assuming the product to be fully dense mixture of $Al_2O_3$ and Cu. For x=6 and 7, $F_o$ is 28.74 and 26.63% by volume $Al_2O_3$. Thus assuming the 2-dimensional image analyses to represent volumetric distributions, E values are calculated as a function of z, as shown in FIGS. 15(*a*) and (*b*) for systems with x=6 and 7, respectively.

Through a least-squares fit of the E values, two experimental parameters of the separation process can be calculated from Eq(32). These are the particle size exponent, a, and the separation time, t. The last parameter is implicit in the definition of $r_z$ in Eq(32). The calculated values for "a" and t for x=6 are −1.8 and 0.61s, respectively. The corresponding values for x=7 are 2.8 and 0.27s.

The calculated times are the durations of the separation process of the two x values. The separation process, of course, takes place only when the copper is in the liquid phase, and thus the total time when the sample temperature is at or above 1083° C. is important. Attempts to measure the temperature profile during the centrifuge experiments were not successful. Determinations of temperature profiles made at 1 $g_o$ and in a non-flowing argon atmosphere showed that the during when T≧1083° C. is 12 and 7s for the systems with x=6 and 7, respectively. These times are higher than the calculated separation times by factors of about 20 and 26, respectively. A complete phase separation would take place if the copper remained in the molten state for the times indicated by the 1 $g_o$ temperature profiles. However, a simple heat transfer analysis {W. Lai, MS thesis, University of California, Davis, Calif. (1996)} shows that in the presence of a flow of argon gas, convective heat loss could reduce the times by a factor of about 30 {R. B. Bird, et al., *Transport Phenomena,* Wiley, New York (1960)}. When taken into account, heat loss would reduce the length of the separation process to 0.4 and 0.21s for the cases of x=6 and 7, respectively. These approximately calculated values are in general agreement with those obtained from Eq(32).

We claim:

1. A method for synthesizing a functionally graded material, comprising:

creating ceramic particles and molten metal in a chamber, wherein said ceramic particles and molten metal are products of a chemical reaction conducted by combustion synthesis under conditions of temperature and relative density that cause ceramic particles of different sizes to be formed in said molten metal; and simultaneously applying centrifugal force to said chamber sufficient to cause said ceramic particles to move relative to said molten metal, such that when said products are later solidified, the solidified product will contain a continuous concentration gradient of said ceramic particles through solidified metal, said ceramic particles further forming a continuous particle size gradient.

2. The method of claim 1 further comprising adding fibrous particles to said chamber prior to application of said centrifugal force.

3. A functionally graded material obtained by creating ceramic particles and molten metal in a chamber, wherein said ceramic particles and molten metal are products of a chemical reaction conducted by combustion synthesis under conditions of temperature and relative density that cause ceramic particles of different sizes to be formed in said molten metal, while applying centrifugal force to said chamber, the centrifugal force being sufficient to cause said ceramic particles to move relative to said molten metal, such that when said products are solidified, the solidified product will contain a continuous concentration gradient of said ceramic particles through solidified metal, said ceramic particles further forming a continuous particle size gradient.

4. The functionally graded material of claim 3 including fibrous particles dispersed therein.

5. The functionally graded material of claim 3 wherein the ceramic particles are selected from the group consisting of $Al_2O_3$ and $ZrO_2$.

6. The functionally graded material of claim 3 wherein the metal is selected from the group consisting of Fe, Cu and Ni.

7. The functionally graded material of claim 6, wherein the metal is Cu or Ni and the ceramic particles are $ZrO_2$.

8. The functionally graded material of claim 6, wherein the metal is Fe or Cu and the ceramic particles are $Al_2O_3$.

* * * * *